US006513434B1

(12) United States Patent
Nakazawa et al.

(10) Patent No.: US 6,513,434 B1
(45) Date of Patent: Feb. 4, 2003

(54) ON-PRESS RECORDING TYPE LITHOGRAPHIC PRINTING METHOD AND APPARATUS

(75) Inventors: Yusuke Nakazawa, Shizuoka (JP); Kazuo Ishii, Shizuoka (JP); Eiichi Kato, Shizuoka (JP); Sadao Ohsawa, Shizuoka (JP)

(73) Assignee: Fuji Photo Film Co., Ltd., Kanagawa-Ken (JP)

( * ) Notice: Subject to any disclaimer, the term of this patent is extended or adjusted under 35 U.S.C. 154(b) by 0 days.

(21) Appl. No.: 09/572,433

(22) Filed: May 17, 2000

(30) Foreign Application Priority Data

May 17, 1999 (JP) ..... 11-135895
Dec. 17, 1999 (JP) ..... 11-359360
Jan. 14, 2000 (JP) ..... 2000-007064

(51) Int. Cl.[7] ..... B41C 1/10; B41J 2/165

(52) U.S. Cl. ..... 101/466; 347/14; 347/19; 347/23; 347/34

(58) Field of Search ..... 101/463.1, 465–467; 347/19, 22, 23, 27, 29, 34, 55, 85, 88, 101, 102, 14

(56) References Cited

U.S. PATENT DOCUMENTS 4,323,905 A * 4/1982 Reitberger et al. ..... 347/19
4,499,475 A * 2/1985 Jinnai ..... 347/19
4,555,712 A * 11/1985 Arway et al. ..... 347/89
4,718,340 A * 1/1988 Love, III ..... 101/467
4,772,900 A * 9/1988 Nagoshi ..... 347/7
4,849,769 A * 7/1989 Dressler ..... 347/27
5,182,580 A * 1/1993 Ikeda et al. ..... 347/19
5,363,132 A * 11/1994 Ikkatai ..... 347/29
5,398,053 A * 3/1995 Hirosawa et al. ..... 347/19
5,428,379 A * 6/1995 Kaneko et al. ..... 347/23
5,841,448 A * 11/1998 Moriyama et al. ..... 347/19
5,988,782 A * 11/1999 Miura et al. ..... 347/100
6,158,838 A * 12/2000 Capurso ..... 347/33
6,158,839 A * 12/2000 Fukushima et al. ..... 347/33
6,199,969 B1 * 3/2001 Haflinger et al. ..... 347/19

FOREIGN PATENT DOCUMENTS

JP 147373 * 9/1983
JP 64-27953 1/1989
JP 4-97848 3/1992
JP 204355 * 8/1998

* cited by examiner

*Primary Examiner*—Stephen R. Funk
(74) *Attorney, Agent, or Firm*—Sughrue Mion, PLLC

(57) ABSTRACT

An on-press recording type lithographic printing method involving an ink jet process which comprises ejecting an oil-based ink onto a printing plate material mounted on the plate cylinder of a press utilizing an electrostatic field according to signals of image data, whereby an image is directly formed on the surface of said printing plate precursor, thereby preparing a printing plate which is then used as it is to effect lithographic printing, characterized in that when any abnormality occurs, the formation of image is suspended and/or the cause of abnormality is removed.

4 Claims, 10 Drawing Sheets

ON-PRESS RECORDING TYPE LITHOGRAPHIC PRINTING METHOD AND APPARATUS

BACKGROUND OF THE INVENTION

1. Field of the Invention

The present invention relates to a lithographic printing method involving digital plate-making on a press and a lithographic printing apparatus therefor. More particularly, the present invention relates to a plate-making/printing method which comprises performing plate-making with an oil-based ink, followed by printing, and a printing apparatus therefor, whereby a printing plate having a good image quality can be provided and a print having a good image quality can be provided.

2. Description of the Related Art

In the field of lithographic printing, ink receptive areas and ink repellent areas are formed on a surface of a printing plate in accordance with an original image. Printing ink adheres to the ink receptive areas to effect printing. Ordinarily, hydrophilic areas and oleophilic (ink receptive) areas are formed in image patterns on the surface of a printing plate, and the hydrophilic areas are converted to oil-based ink repellent areas by applying dampening water thereto.

Conventional image formation on a printing plate (plate-making) is carried out by exposing a silver salt photographic film with the desired image in an analog or digital manner, exposing a photopolymer material (original printing plate precursor) containing a diazo resin or a photopolymerizable polymer to the silver halide photographic film, and then removing the photosensitive material by dissolving out the non-image areas. This removal process is carried out mainly by using an alkaline solution.

With recent improvements in digital recording technology and the demand for more efficient printing processes, various methods where digital image information is directly recorded on a plate material have been proposed. These methods include technologies referred to a CTP (computer-to-plate) and a DDPP (digital direct printing plate) method. These methods typically involve an image recording system having a photon mode or heating mode using a laser beam. Some of these methods have been put to practical use.

However, after the image is recorded on a plate using either the photon mode or the heating mode, the non-image areas are dissolved out by treating the plate with an alkaline developer. This method results in the discharge of an alkaline waste liquid, which is environmentally undesirable.

As a means of effecting the printing process at an enhanced efficiency there is proposed a system in which image recording is effected on the press. The foregoing method involving the use of laser may be employed. However, this method requires an expensive and large-sized apparatus. Thus, a system utilizing an ink jet method which employs an inexpensive and compact image recording apparatus has been attempted JP-A-4-97848 (The term "JP-A" as used herein means an "unexamined published Japanese patent application") discloses a method which comprises forming a lipophilic or hydrophilic image on a plate drum which is hydrophilic or lipophilic on the surface thereof instead of the conventional plate cylinder by an ink jet process, and then removing the image after printing to clean the plate drum. However, this method is disadvantageous in that the desired removability of printed image (i.e., cleanability) and press life cannot be accomplished at the same time. In order to form a printed image having a prolonged press life on the plate cylinder, it is necessary that an ink containing a resin in a relatively high concentration be used. Thus, the inkjet recording device for forming a printed image uses a resin solution as an ink. Accordingly, the resin can be easily solidified due to the evaporation of solvent at the nozzle, deteriorating the stability in the ejection of ink. As a result, a good image can hardly be obtained.

Further, JP-A-64-27953 discloses a plate-making method which comprises recording an image of a lipophilic wax ink on a hydrophilic printing plate material by an ink jet recording process. However, this method is disadvantageous in that since the image is formed of a wax, the resulting image area has a reduced mechanical strength. This method is also disadvantageous in that the adhesion of the image area to the hydrophilic surface of the printing plate material is insufficient, reducing the press life.

SUMMARY OF THE INVENTION

The present invention has been worked out paying attention to the foregoing problems. A first object of the present invention is to provide an on-press recording type lithographic printing method and apparatus for use with a digital recording system requiring no development. A second object of the present invention is to provide an on-press recording type lithographic printing method and apparatus capable of providing a large number of prints having sharp images of high quality in a simple and inexpensive manner.

The foregoing object of the present invention is accomplished by the following aspects of the present invention.

(1) An on-press recording type lithographic printing method involving an ink jet process which comprises ejecting an oil-based ink onto a printing plate material mounted on the plate cylinder of a press utilizing an electrostatic field according to signals of image data, whereby an image is directly formed on the surface of said printing plate precursor, thereby preparing a printing plate which is then used as it is to effect lithographic printing, characterized in that when any abnormality occurs, the formation of image is suspended and/or the cause of abnormality is removed.

(2) The on-press recording type lithographic printing method according to Clause (1), wherein the oil-based ink is a dispersion comprising resin particles which are solid and hydrophobic at least at ordinary temperature dispersed in a nonaqueous solvent having an electrical specific resistance of $10^9$ Ω-cm or more and a dielectric constant of 3.5 or less.

(3) An on-press recording type lithographic printing apparatus comprising an ink jet recording device provided with a recording head which ejects an oil-based ink utilizing an electrostatic field as an image forming means for directly forming an image on a printing plate material according to signals of image data utilizing an electrostatic field and a lithographic printing means for effecting lithographic printing using a printing plate formed by the image forming means, characterized in that there are provided an abnormality sensing means and/or a means of removing the cause of abnormality and the image forming means is suspended and/or the means of removing the cause of abnormality is operated at least temporarily according to the output from the abnormality sensing means.

(4) The on-press recording type lithographic printing apparatus according to Clause 3, wherein as the abnormality sensing means there is provided a recording head foreign matter attachment sensing device for sensing the attachment of foreign matters to the ink jet recording device.

(5) The on-press recording type lithographic printing apparatus according to Clause 3, wherein as the abnormality sensing means there is provided a dust sensing device for sensing dust inside the on-press recording type lithographic printing apparatus and/or on the printing plate material.

(6) The on-press recording type lithographic printing apparatus according to Clause 3, wherein as the abnormality sensing means there is provided a vibration sensing device for sensing the vibration of the on-press recording type lithographic printing apparatus and/or the recording head.

(7) The on-press recording type lithographic printing apparatus according to Clauses 3 to 7, wherein the oil-based ink is a dispersion comprising resin particles which are solid and hydrophobic at least at ordinary temperature dispersed in a nonaqueous solvent having an electrical specific resistance of $10^9$ Ω-cm or more and a dielectric constant of 3.5 or less.

(8) The on-press recording type lithographic printing apparatus according to Clauses 3 to 7, wherein there is provided a device for fixing the ink.

(9) The on-press recording type lithographic printing apparatus according to Clauses 3 to 8, wherein the image forming means comprises a printing plate material surface dust removing means for removing dust present on the surface of the printing plate material before and/or during the recording of an image on the printing plate material.

(10) The on-press recording type lithographic printing apparatus according to Clauses 3 to 9, wherein the image forming means performs main scanning during the recording of an image onto the printing plate material, by rotation of the plate cylinder in which the printing plate material is mounted.

(11) The on-press recording type lithographic printing apparatus according to Clause 10, wherein the recording head comprises a single channel head or multiple channel head and the recording head moves in the direction parallel to the axis of the plate cylinder during the recording of an image on the printing plate material to effect subsidiary scanning.

(12) The on-press recording type lithographic printing apparatus according to Clause 10, wherein the recording head comprises a full-line head having a length which is almost the same as the width of the plate cylinder.

(13) The on-press recording type lithographic printing apparatus according to Clauses 3 to 12, wherein the ink jet recording device comprises an ink supplying means for supplying an ink into the recording head.

(14) The on-press recording type lithographic printing apparatus according to Clause 13, wherein there is provided an ink recovering means for recovering an ink from the recording head and ink circulation is carried out by the ink supplying means and the ink recovering means.

(15) The on-press recording type lithographic printing apparatus according to Clauses 3 to 14, wherein there is provided an ink stirring means in an ink tank housing an oil-based ink.

(16) The on-press recording type lithographic printing apparatus according to Clauses 3 to 15, wherein there is provided an ink temperature controlling means in the ink tank housing an oil-based ink.

(17) The on-press recording type lithographic printing apparatus according to Clauses 3 to 16, wherein there is provided an ink concentration controlling means for controlling the concentration of the ink.

(18) The on-press recording type lithographic printing apparatus according to Clauses 3 to 17, wherein the ink jet recording device is provided with a recording head moving means for moving the recording head close to the plate cylinder during the recording of an image on the printing plate material and moving the recording head away from the plate cylinder except during the recording of an image on the printing plate material.

(19) The on-press recording type lithographic printing apparatus according to Clauses 3 to 18, wherein the image forming means is provided with a recording head cleaning means for cleaning the recording head at least after the termination of plate making.

(20) The on-press recording type lithographic printing apparatus according to Clause 3, wherein there is provided a means for protecting the recording head.

(21) The on-press recording type lithographic printing apparatus according to Clause 19, wherein the recording head cleaning means applies a voltage to the recording head while the recording head is being dipped in a cleaning fluid.

PREFERRED EMBODIMENTS OF THE INVENTION

Figure 1:
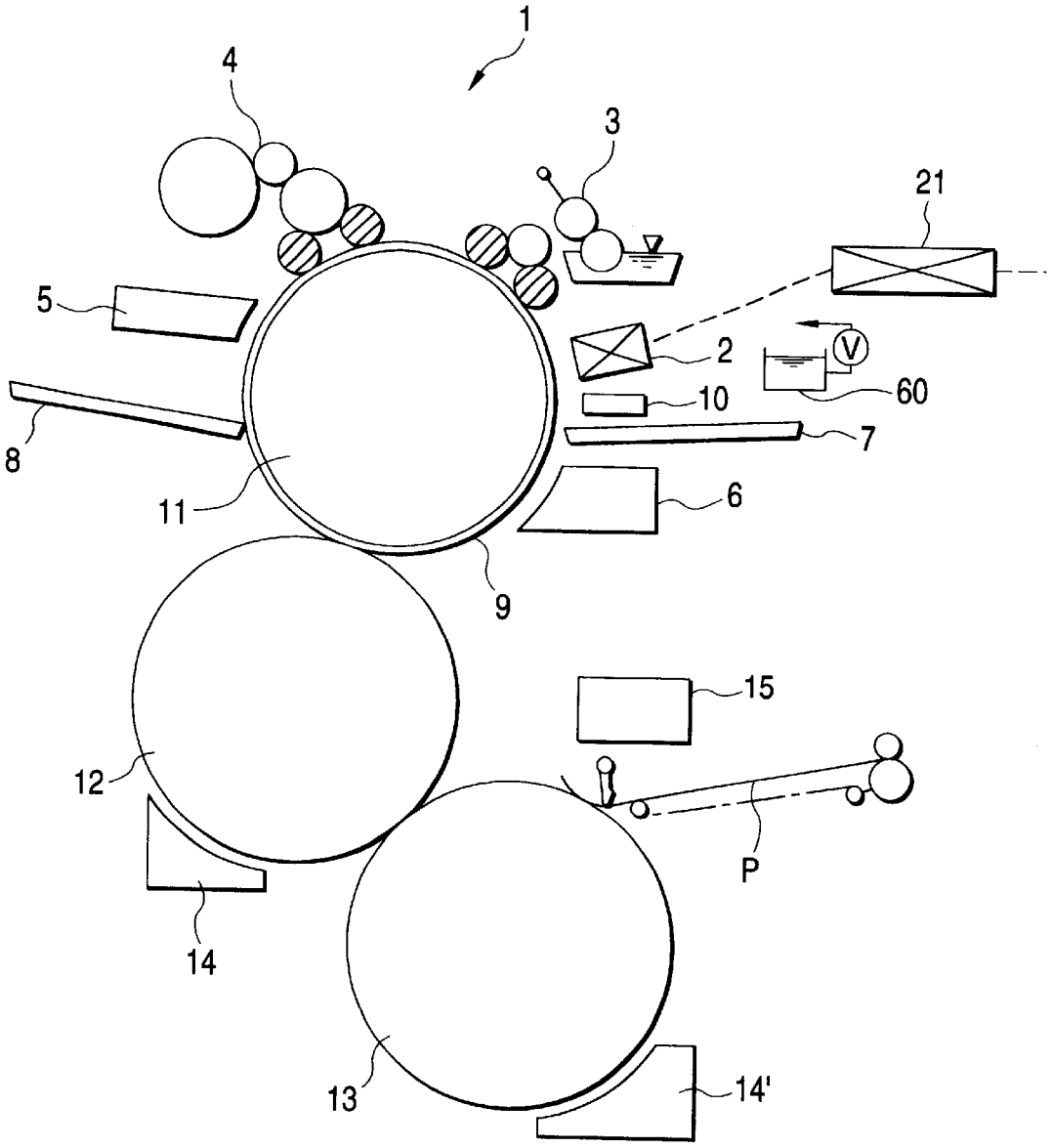
FIG. 1 is a schematic diagram illustrating the entire configuration of an embodiment of the on-press recording type monochromatic lithographic printing apparatus used in the present invention.

Embodiments of implication of the present invention will be further described hereinafter.

The present invention is characterized in that image formation is carried out by an ink jet recording method in which an oil-based ink is ejected utilizing an electrostatic field onto a printing plate material (printing plate precursor) provided on the plate cylinder of a press.

The ink jet printing method according to the present invention is disclosed in PCT WO93/11866. In this ink jet printing method, an ink having a high resistivity having resin particles which are solid and hydrophobic at least at ordinary temperature dispersed in an insulating solvent is used. By allowing a strong electric field to be acted on the ink at the ejection position, aggregates of the colored particles are formed at the ejection position. Further, the aggregates are ejected from the ejection position by an electrostatic device. In this manner, the resin particles are ejected in the form of highly concentrated aggregates, making it possible to print dots on the printing plate precursor to a sufficient thickness. In this manner, an image made of condensed resin particles having a sufficient press life is formed on the printing plate precursor as a recording medium. In the ink jet recording method used in the invention, the size of the ejected ink droplets is determined by the size of the tip of the ejection electrode or the conditions of the formation of electric field. Accordingly, by using a small ejection electrode or adjusting the conditions of the formation of electric field, minute ink droplets can be formed without reducing the ejection nozzle diameter or the ejection slit width. By controlling the conditions of the formation of electric field, the diameter of dots formed on the printing plate precursor can be controlled. Accordingly, in accordance with the present invention, image formation can be controlled so as to provide a minuteness and a prolonged press life without clogging the ink head. Thus, the present invention provides a lithographic printing method and apparatus capable of providing a large number of prints of clear images.

When this ink jet recording method is applied to lithographic printing, the resin particles are ejected in the form of highly concentrated aggregates, making it possible to print dots on the printing plate precursor to a sufficient thickness. In this manner, an image made of condensed resin particles having a sufficient press life is formed on the printing plate precursor as a recording medium. Further, since the resin particles are ejected in the form of highly concentrated aggregates and the ejected droplets contain so little solvent components that they can quickly dry, the ink can be prevented from running from the dots on the printing plate, making it possible to form a high precision image.

Further, in the ink jet recording method used in the present invention, the size of the ejected ink droplets is determined by the size of the ejection position, the shape of the electrode and the application condition of the applied electric field. In accordance with the ink jet recording method, minute ink droplets can be formed without reducing the ejection nozzle diameter or the ejection slit width. By controlling the application condition of the applied electric field, the diameter of dots formed on the printing plate precursor can be controlled.

Thus, in accordance with the present invention, a large number of prints of clear images can be printed.

The ink jet recording method of the present invention is preferably effected utilizing an electrostatic field so that a strong electric field is acted on the ink to eject the ink. When the intensity of electric field applied is not sufficient, good ejectability may not be obtained. Thus, the electric field to be applied is preferably about $1\times10^5$ V/cm or higher. On the contrary, when the intensity of electric field applied is too high, the split or satellization of dots occurs, giving a tendency toward deterioration of image quality. Thus, the electric field to be applied is preferably about $1\times10^8$ V/cm or lower. More preferably, the electric field to be applied is from $2\times10^5$ V/cm to $5\times10^8$ V/cm.

An example of the configuration of on-press recording type lithographic printing apparatus for use in the implication of the lithographic printing method according to the invention will be described hereinafter.

FIG. 1 is a diagram illustrating the entire configuration of an on-press recording type monochromatic single-sided lithographic printing apparatus.

Figure 2:
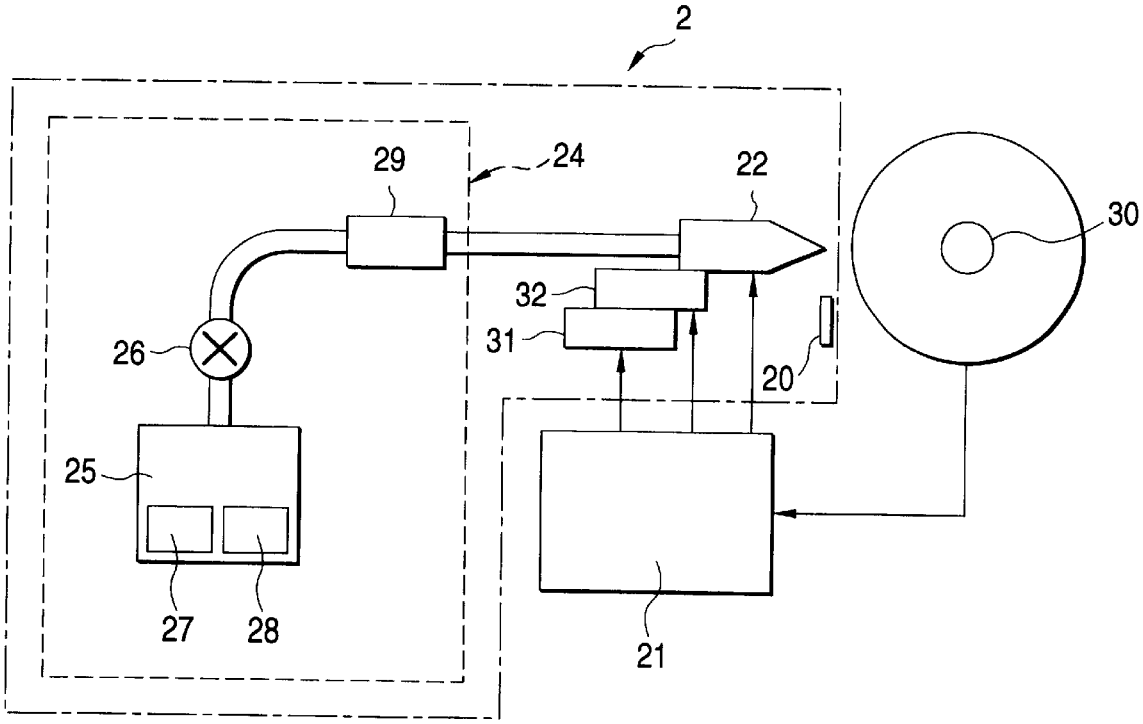
FIG. 2 is a schematic diagram illustrating the entire configuration of an embodiment of the recording portion of the on-press recording type lithographic printing apparatus used in the present invention.

FIG. 2 is a schematic diagram illustrating the configuration of the recording portion including a controller, an ink supplier and a mechanism for moving a head toward or away in the on-press recording type lithographic printing apparatus.

Figure 8:
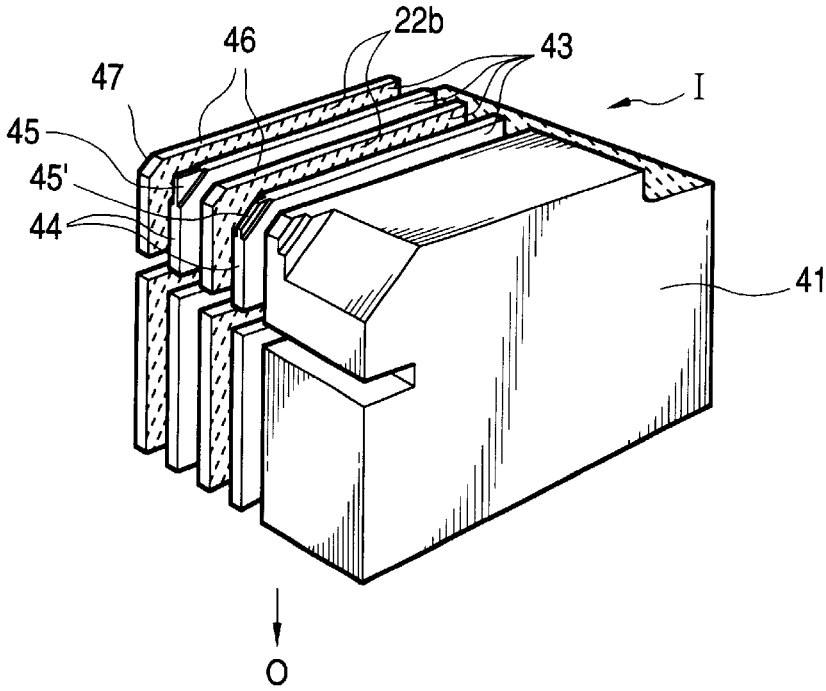
FIG. 8 is a schematic diagram illustrating the configuration of the head of FIG. 7 from which regulating plates are removed.
Figure 9:
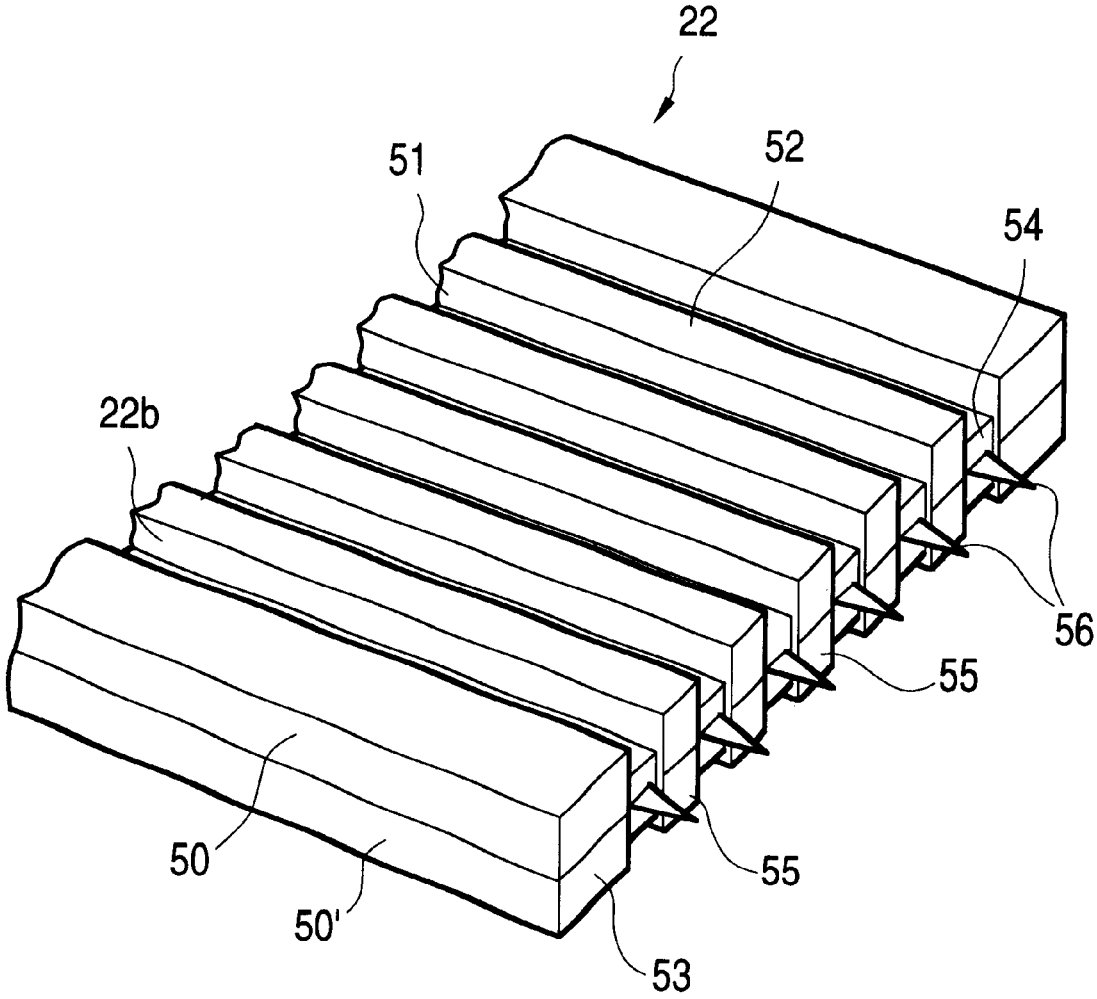
FIG. 9 is a schematic diagram illustrating the configuration of an essential part of a still further embodiment of the head provided in the ink jet recording device used in the present invention.
Figure 10:
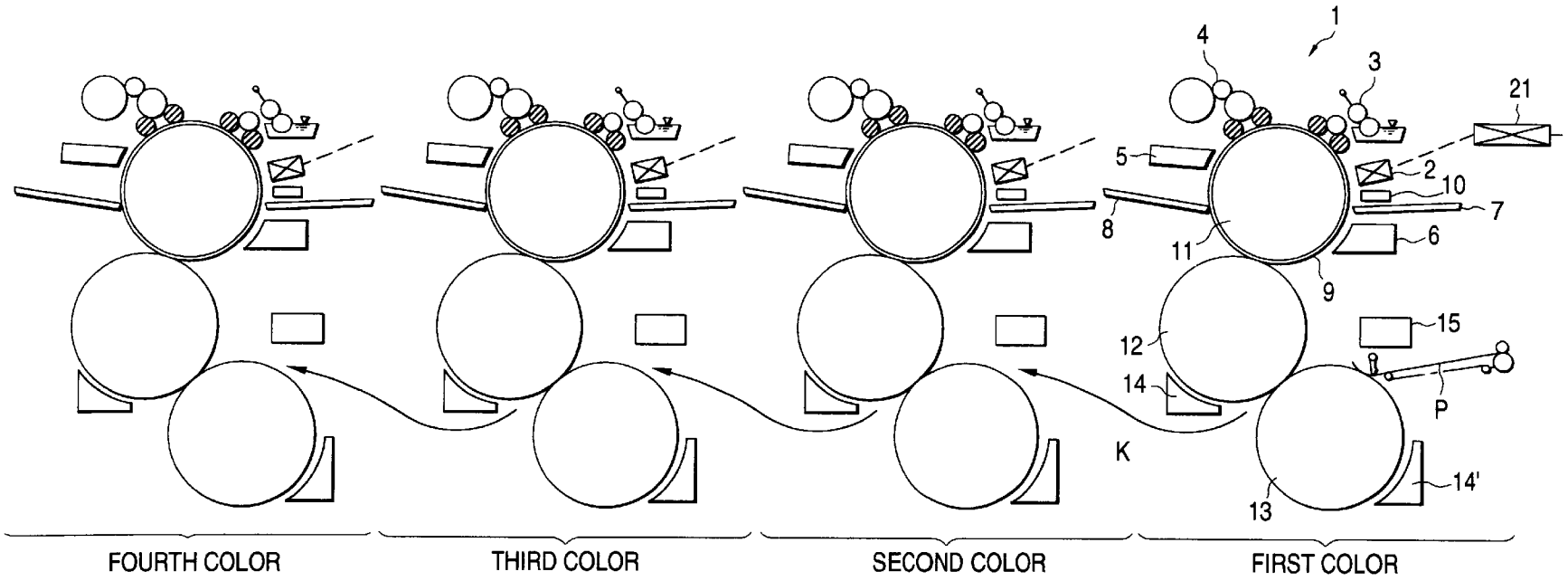
FIG. 10 is a schematic diagram illustrating the entire configuration of an on-press recording type four-color single-sided lithographic printing apparatus as an example of the copying machine according to the present invention.
Figure 11:
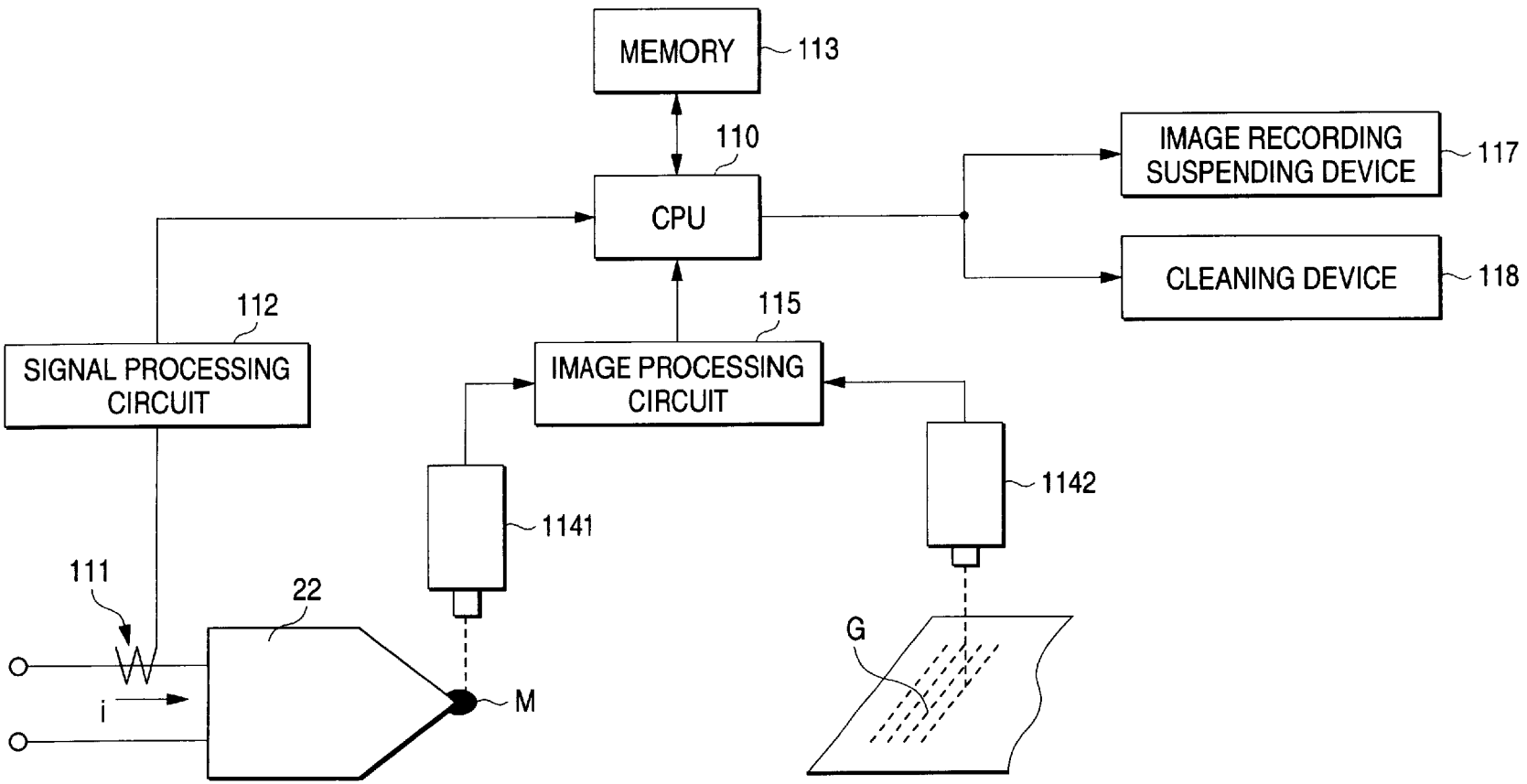
FIG. 11 is a diagram illustrating an example of the method for sensing abnormal current to the head, defects in image quality and abnormal shape of meniscus.
Figure 12:
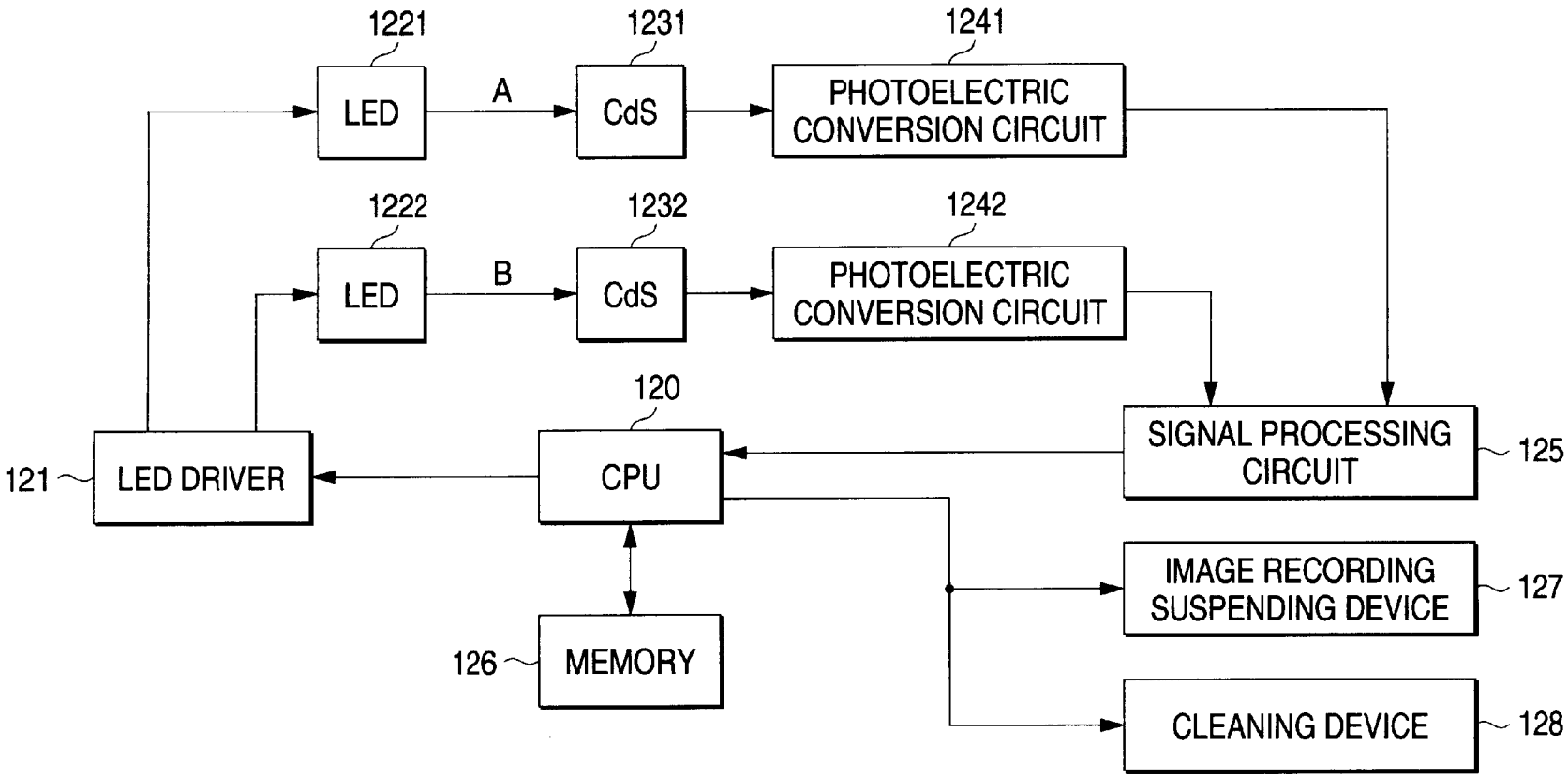
FIG. 12 is a diagram illustrating an example of the dust sensing device using an optical sensing method.

FIGS. 3 to 9 are diagrams illustrating the ink jet recording device provided in the on-press recording type lithographic printing apparatus of FIGS. 1 and 10. FIG. 10 is a diagram illustrating the entire configuration of an on-press recording type four-color single-sided lithographic printing apparatus according to the invention. FIG. 11 is a diagram illustrating an example of the method for sensing abnormal current to the head, defects in image quality and abnormal shape of meniscus. FIG. 12 is a diagram illustrating an example of the dust sensing device using an optical sensing method.

The printing process according to the invention will be described hereinafter in connection with the entire configuration of on-press recording type monochromatic single-sided lithographic printing apparatus shown in FIG. 1. As shown in FIG. 1, an on-press recording type lithographic printing apparatus 1 (hereinafter referred to as "printing apparatus") 1 comprises a plate cylinder 11, a blanket cylinder 12 and an impression cylinder 13 provided therein. The transferring blanket cylinder 12 is arranged so as to be pressed against the plate cylinder 11 at least during lithographic printing. The impression cylinder 13 for transferring a printing ink image which has been transferred to the blanket cylinder 12 to a printing paper P is arranged pressed against the blanket cylinder 12.

The plate cylinder 11 is usually made of a metal. The surface of the plate cylinder 11 is plated with chromium to enhance its abrasion resistance. The plate cylinder 11 may have a heat insulator material on the surface thereof as described later. On the other hand, the plate cylinder 11 is preferably grounded because it acts as a counterelectrode to an electrode of the ejection head during ejection under an electrostatic field. When the substrate of the printing plate precursor is a good insulator, it is preferable to provide a conductive layer on the substrate of the precursor. In this case, the conductive layer is preferably grounded to the plate cylinder. In a case where a heat insulator is provided on the plate cylinder 11 as described above, recording is more easily accomplished by providing the printing plate precursor with a ground. Examples of the ground employable herein include a known conductive brush, leaf spring, and roller.

The printing apparatus 1 also has an ink jet recording device 2 which ejects an oil-based ink onto the printing plate precursor 9 mounted on the plate cylinder 11. The ink is ejected in accordance with image data transmitted from an arithmetic and control unit 21, to thereby form an image on the printing plate precursor.

The printing apparatus 1 further comprises a dampening water supplier 3 installed therein for supplying dampening water onto the water receptive layer (non-image area) of the printing plate precursor 9. FIG. 1 illustrates a Morton process water supplier as a typical example of the dampening water supplier 3. Other examples of the dampening water supplier 3 employable herein include known apparatus such as synchronous process water supplier and continuous process water supplier. The printing apparatus 1 further comprises a printing ink supplier 4 and a fixing device 5 for adhering the oil-based ink image formed on the printing plate precursor 9. Additionally, a plate surface oil-desensitizing device 6 may be installed depending on the type of printing plate precursor 9 for increasing the hydrophilic properties of the surface of the printing plate precursor 9 as necessary. The printing apparatus 1 also has a means 10 for removing dust present on the surface of the printing plate precursor before and/or during the process of recording the image on the printing plate precursor 9. Examples of the dust remover include a contact method using a brush or a roller, in addition to a conventional non-contact method involving suction, blowing or electrostaticity. In the present invention, the removal method is preferably one that uses suction, blowing or a combination thereof. In this case, an air pump commonly used for paper feeder may be used for this purpose.

Further, the printing apparatus may comprise a recording head cleaning device 60 according to the present invention. The recording head cleaning device 60 will be described later.

An automatic plate material supplying device 7 by which the printing plate precursor 9 for printing is fed automatically to the plate cylinder 11, and an automatic plate material discharging device 8 by which the printing plate precursor 9 is removed from the plate cylinder 11 after the printing process may be installed. Examples of the press comprising these devices, which are known as auxiliary devices for press, include HAMADA VS34A, B452A (produced by HAMADA PRINTING PRESS CO., LTD.), TOKO 8000PFA (produced by Tokyo Kouku Keiki K.K.), RYOBI 3200ACD, 3200PFA (produced by Ryobi Imagics Co., Ltd.), AMSIS Multi5150FA (produced by Nihon AM Co., Ltd.), Oliber 266EPZ (produced by Sakurai Graphics Systems Co., Ltd.), and Sinohara 66IV/IVP (produced by Shinohara Shoji K.K.). Further, a blanket cleaner 14 and an impression cylinder cleaner 14' may be installed. The use of these devices 7, 8, 14 and 14' can make the printing operation simpler and shorter, so that the effects of the invention can be further enhanced. Further, a paper dust generation inhibiting device (paper dust removing device) 15 may be installed in the vicinity of the plate cylinder 13, making it possible to prevent paper dust from adhering to the printing plate precursor. The paper dust generation inhibiting device 15 can operate by humidity control, suction by air or electrostaticity, or the like.

The arithmetic and control unit 21 receives image data from, e.g., an image scanner, a magnetic disk device or an image data communication device, and not only carries out color separation but also processing of the separated data into appropriate numbers of pixels and gradations. In addition to these operations, the control unit 21 calculates dot area percentage in order to enable the recording of oil-based ink images in halftone dots by means of an ejection head 22 (see FIG. 2 explained in detail hereinafter) as a recording head with which the ink jet recording device 2 is equipped.

Furthermore, as described below, the arithmetic and control unit 21 controls the movement of ejection head 22 and the time at which the oil-based ink is ejected and, if desired, the timing of the rotation of the plate cylinder 11, the blanket cylinder 12, the impression cylinder 13, etc.

A method of preparing a printing plate using the printing apparatus 1 is described below with reference to FIG. 1 and a portion of FIG. 2.

The printing plate precursor 9 is first mounted on the plate cylinder 11 using the automatic plate material supplying device 7. The printing plate precursor 9 is brought into close contact with and fixed firmly to the plate cylinder by means of a well-known mechanical device such as a plate end gripping device or an air suction device, or by a well-known electrostatic device. Due to this firm fixation, the end of the plate precursor 9 is prevented from flapping against and damaging the ink jet recording device 2 during the recording process. Also, it is possible to prevent the printing plate precursor 9 from scraping against the ink jet recording device by using an arrangement which brings the printing plate precursor into close contact with the plate cylinder only in the neighborhood of the recording position of the ink jet recording device. Specifically, the arrangement may be, for example, hold-down rollers disposed on both upstream and downstream sides of the recording position of the plate cylinder. Further, an arrangement may be provided such that the end of the printing plate precursor is kept away from the ink supplying roller, making it possible to inhibit stain on the surface of the printing plate and hence reduce the number of sheets of waste paper. Specifically, hold-down rollers, guides, electrostatic attraction, etc. are effective.

Image data from a magnetic disc device or the like is given to the arithmetic and control unit 21. The arithmetic and control unit 21 then calculates the ejection position of oil-based ink and dot area percentage at the ejection position according to the image data thus inputted. The arithmetic data input to the arithmetic and control unit 21 is temporarily stored in a buffer. The arithmetic and control unit 21 instructs the rotation of the plate cylinder 11 and, at the same time, switches on an ejection head moving device (recording head moving device) 31 which moves the ejection head 22 towards or away from the plate cylinder 11. The distance between the ejection head 22 and the surface of the printing plate precursor 9 mounted on the plate cylinder 11 is maintained at a predetermined value during recording at a desired value by mechanical distance control, e.g., using a contact roller or by controlling the ejection head moving device 31 in accordance with signals from an optical distance detector. For the ejection head 22, a single channel head, multiple channel head or full-line head can be used. Main scanning is carried out by rotating the plate cylinder 11. In the case of a multiple channel head having plural ejecting portions or full-line head, the arranging direction of the ejecting portions is in the axial direction of the plate cylinder 11. In the case of single channel head or multiple channel head, according to instructions from the arithmetic and control unit 21, the head 22 is moved in the direction parallel to the axis of the plate cylinder every rotation of the plate cylinder 11. The oil-based ink is ejected from the head towards the printing plate precursor 9 mounted on the plate cylinder 11 at a position and with the dot area percentage determined by operations performed by the control unit 21. As a result, a dot image with gradations corresponding to the original is recorded with the oil-based ink on the printing plate precursor 9. These operations are continued until the oil-based ink image corresponding to one-color information of the original is formed on the printing plate precursor to prepare a printing plate. On the other hand, in the case of full-line head comprising an ejection head having a length which is almost the same as the width of the plate cylinder, as the plate cylinder performs one rotation, the oil-based ink image corresponding to one-color information of the original is formed to complete a printing plate. As described above, the plate cylinder is rotated to effect main scanning so that positional precision in the main scanning direction is enhanced and high-speed recording becomes feasible.

Subsequently, the ejection head 22 is moved away from the position close to the plate cylinder 11 in order to protect the ejection head 22. During this operation, only the ejection head may be moved away from the plate cylinder 11. However, the ejection head 22 may be moved away from the plate cylinder 11 together with a head subsidiary scanning means 32 or together with the ink supplier 24 and the head subsidiary scanning means 32. Alternatively, an arrangement may be made such that the fixing device 5 and the dust remover 10 can be moved away from the plate cylinder 11 in the same manner as the ejection head 22, the ink supplier 24 and the head subsidiary scanning means 32, whereby the printing apparatus can be used also in ordinary printing.

The device for moving the head towards and away operates so as to keep the recording head at least 500 $\mu$m away from the plate cylinder except during image recording. This movement may be effected using a sliding system or a mechanism by which the head is gripped with an arm fixed on a shaft and moved in a pendulum-like motion by turning the shaft. By keeping the head away from the plate cylinder when image formation is not being carried out, the head is protected from physical damage and contamination. As a result, the life of the head can be extended.

The oil-based ink image formed by the head is hardened by heating or like means using a fixing device 5. Well-known fixing techniques, such as heat fixing and solvent fixing, can be employed for fixing the ink image. In the case of heat fixing, irradiation with an infrared lamp, halogen lamp or xenon flash lamp, hot air fixing using a heater or fixing using a heated roller can be usually used. In such a case, for increasing the fixing efficiency, measures may be adopted such as previously heating the plate cylinder, previously heating the printing plate precursor, performing the recording under exposure to hot air, using a plate cylinder coated with a heat insulator, or heating the printing plate precursor alone by separating the printing plate precursor from the plate cylinder only at the time of fixing. These measures may be employed in combination of two or more thereof. Flash fixing using, e.g., a xenon lamp, is well-known as a fixing method for electrophotographic toner, and has the advantage of performing the fixing in a short time.

In the case of solvent fixing, a solvent capable of dissolving the resin component of the ink, such as methanol and ethyl acetate, is sprayed onto the printing plate precursor, and the excess solvent vapor is recovered.

It is desirable, at least during the portion of the process from formation of the oil-based ink image by means of the ejection head 22 to the fixing of the image with the fixing device 5, for the dampening water supplier 3, the printing ink supplier 4 and the blanket cylinder 12 to be prevented from coming into contact with the printing plate precursor 9 on the plate cylinder.

The printing plate thus prepared is then subjected to printing process in the same manner as known lithographic printing method. More specifically, the printing plate 9 having the oil-based ink image formed thereon is given a printing ink and a dampening water to form a printing ink image thereon. The printing ink image thus formed is transferred onto a blanket cylinder 12 rotating in concert with the plate cylinder 11, and then the printing ink image on the blanket cylinder 12 is transferred to printing paper passing between the blanket cylinder 12 and the impression cylinder 13 to conduct printing corresponding to one-color information of the original. After the printing operation, the printing plate is removed from the plate cylinder 11 by an automatic plate remover 8, and a blanket on the blanket cylinder 12 is cleaned with a blanket cleaning device 14 so that it is restored to a printable state.

The sensing device of the invention will be further described hereinafter.

The sensing device is adapted to sense the attachment of foreign matters to the head, dust, vibration, etc.

The sensing of the attachment of foreign matters to the head is carried out by sensing abnormal current through the head, image defects and abnormal shape of meniscus, whereby image recording is suspended and/or the cleaning device for the head is actuated.

An example of the method for sensing abnormal current through the head, image defects and abnormal shape of meniscus is shown in FIG. 11. In some detail, when dust is attached to the head, current discharge is effected continuously or at a reduced interval of time, causing an extraordinarily higher current to flow through the head than during normal time. In order to detect such an abnormal current through the head, current i flowing through the head is detected by a current detecting circuit 111. The resulting electrical signal is converted by a signal processing circuit 112 to a digital signal which is then sent to CPU 110. CPU 110 compares the digital signal with a reference value stored in a memory 113. Whenever the results of comparison show that the digital signal falls outside the tolerance, an image recording suspending device 117 and/or a cleaning device 118 is actuated.

The sensing of abnormal shape of meniscus is accomplished, e.g., by a method which comprises taking a picture of the shape of a meniscus M formed on the head 22 with the oil-based ink by capillary action by a CCD camera 1141 provided in the vicinity of the head, and then processing the picture by an image processing circuit 115 and CPU 110 to measure the shape of meniscus M which is then compared with the reference shape of meniscus M stored in the memory 113 by CPU 110. When no dust is attached to the head 22, CCD camera 1141 takes a picture of normal meniscus. On the contrary, when dust is attached to the head 22, CCD camera 1141 takes a picture of strained shape. When the results of comparison show that the strained shape falls outside the tolerance, CPU 110 actuates the image recording suspending device 117 and/or cleaning device 118.

The sensing of image defects can be essentially accomplished by the same method as the method for sensing abnormal shape of meniscus. In some detail, an image G recorded is taken a picture of by a CCD camera 1142 provided in the vicinity of the image. The picture thus taken is converted by the image processing circuit 115 to a digital signal which is then sent to CPU 110 which in turn compares the digital signal with a reference image data stored in the memory 113. When the image data falls outside a predetermined tolerance, CPU 110 actuates the image recording suspending device 117 and/or cleaning device 118.

When the printing apparatus is kept suspended over an extended period of time, the cleaning device is properly actuated.

The sensing of dust is accomplished by sensing dust attached to the printing plate or flying in the apparatus. As the sensing device there may be used an optical sensing device. Alternatively, the weight of dust collected by filtering may be sensed. The optical sensing method is preferably employed.

FIG. 12 is a diagram illustrating an example of the dust sensing device using an optical sensing method.

A plurality of pairs of light-emitting devices and light-receiving elements 1221 to 1231 and 1222 to 1232 are provided on the printing plate (A) on which dust is to be detected and in a place (B) in the apparatus where dust can easily fly, respectively. The light-emitting devices 1221 and 1222 are LED's which are connected to LED driver 121. LED driver 121 causes the light-emitting elements 1221 and 1222 to emit light according to control of CPU 120. On the other hand, the light-receiving elements 1231 and 1232 are phototransistors which are connected to photoelectric conversion circuits 1241 and 1242, respectively. When the light-receiving elements 1231 and 1232 receive light emitted by the light-emitting devices 1221 and 1232, respectively, the light signal is converted by the photoelectric conversion circuits 1241 and 1242, respectively, to an electrical signal which is then outputted to the signal processing circuit 125. The signal processing circuit 125 converts the electrical signal from the first and second light-emitting elements 1231 and 1232 to a digital signal which is then sent to CPU 120. CPU 120 compares the digital signal thus received with the reference value stored in the memory 126. When the results of comparison show that the digital signal falls outside the tolerance, the image recording suspending device 127 and/or cleaning device 128 is actuated.

The printing apparatus 1 comprises a printing plate surface dust removing device 10 for removing dust present on the surface of the printing plate material before and/or during the recording of an image on the printing plate material. The dust removing device 10 may employ contact process by means of a brush, roller or the like besides non-contact process such as known suction method, blow-off method and electrostatic method. In the present invention, either or both of air suction method and air blow-off method may be employed. In this case, an air pump which is usually used in the paper supplying device may be used for this purpose.

Alternatively, a paper dust generation inhibiting device 15 is installed in the vicinity of the impression cylinder 13 as a dust generation inhibiting device, whereby the attachment of paper dust to the surface of the printing plate material can be inhibited. The paper dust generation inhibiting device 15 may be operated by a method involving humidity control or suction by air or electrostatic force.

The sensing of vibration is carried out by sensing the vibration of the head and/or plate cylinder, singly and/or relative to each other, whereby image recording is suspended and/or cancelled. This operation is carried out by suspending only the supply of image signal into the head and/or suspending the movement of the plate cylinder/head.

The ink jet recording device 2 will be described in more detail below.

The image recording portion used in the lithographic printing device of the invention comprises an ink jet head 2, and an ink supplier 24, as shown in FIG. 2. The ink supplier 24 has an ink tank 25, an ink supplying device 26 and an ink concentration controlling device 29. The ink tank 25 is furnished with a stirrer 27 and an ink temperature controlling device (ink temperature controller) 28. The ink may be circulated through the ejection head. In this case, the ink supplier has a recovering function in addition to the circulatory function. The ink stirrer 27 inhibits the solid component of the ink from precipitating and aggregating. Examples of the ink stirrer 27 include a rotating blade, an ultrasonic vibrator and a circulatory pump. These tools can be used singly or in combination. The ink temperature controlling device 28 is arranged so as to prevent the physical properties of the ink from changing due to change in ambient temperature, thereby ensuring no change in dot diameter so as to form a consistently high-quality image. To control the ink temperature, a well-known method can be adopted. More specifically, the ink tank can be provided with a heating element such as a heater or a Peltie element or a cooling element together with the stirrer so as to make the temperature distribution inside the ink tank uniform, and the temperature is controlled with a temperature sensor such as thermostat. It is desirable that the ink temperature inside the ink tank be from 15° C. to 60° C., and preferably from 20° C. to 50° C. The stirrer may be used for both purposes of keeping the temperature distribution uniform and for preventing precipitation and aggregation of the solid component of the ink. For achieving high-quality image formation, the printing apparatus of the present invention is further provided with an ink concentration controlling device 29. Ink concentration control is carried out by optical detection, measurement of physical properties such as electric conductivity or viscosity, or monitoring a number of printing plate precursors subjected to image formation. More specifically, the ink concentration is controlled by feeding concentrated ink from an ink tank 25 for replenishment or ink carrier tank for dilution (not shown) in accordance with output signals from an optical detector, a conductivity measuring instrument and a viscosity measuring instrument provided individually or in combination inside the ink tank 25, or ink flow course in the case of control in accordance with measurement of physical properties, or based on a number of printing plates made or a frequency of plate-making operations in the case of monitoring the number of printing plate precursors subjected to image formation.

Figure 13:
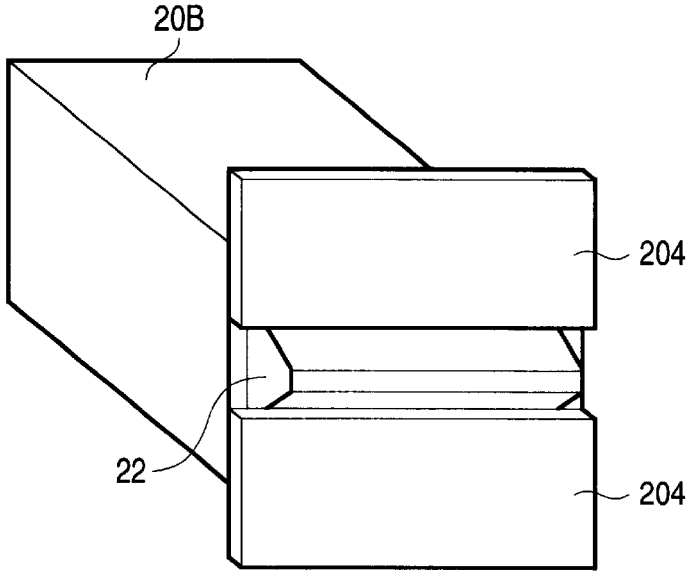
FIG. 13 is a schematic diagram illustrating the configuration of an example of the head protecting cover used in the present invention.

As shown in FIG. 2, the image recording portion used in the present lithographic printing apparatus may comprise a head protective device 20. Examples of such a head protective device include a device for preventing the attachment of foreign matters to the head, and a device for suspending image recording upon occurrence of abnormality. An example of the foreign matter attraction preventive device is a head protecting cover. In some detail, while image recording is not being effected, the head can be housed in such a cover, making it possible to prevent the attachment of foreign matters to the head. FIG. 13 illustrates an example of the cover according to the invention. As shown in FIG. 13, the head is housed in a cover 20B with a shutter 204. In this arrangement, while image recording is being effected, the shutter is kept open so that the head portion can be moved forward to the image recording position. The interior of the cover may be filled with an ink or ink solvent. In this case, troubles due to the adhesion of the ink to the head can be prevented even when image recording is not effected over an extended period of time. As a device for suspending image recording upon occurrence of abnormality, a dust sensing device or head abnormal current sensing device may be connected to an image data arithmetic and control unit 21, whereby a mechanism can be provided for suspending the supply of voltage signal to the head when such a sensing device generates an abnormal signal to prevent damage on the head.

The arithmetic and control unit 21, as described above, not only performs arithmetical operations on input image data and controls movement of the ejection head with the ejection head moving device 31 or the head subsidiary scanner 32, but also receives a timing pulse from an encoder 30 attached to the plate cylinder and carries out operation of the ejection head 22 in accordance with the timing pulse. As a result, positional precision in the direction of subsidiary scanning is improved. During the image recording by the ink jet recording device, the use of a driving means having a high precision different from the driving means for printing allows the plate cylinder to be driven in an enhanced positional precision in the direction of subsidiary scanning. During this procedure, the plate cylinder is preferably released mechanically from the blanket cylinder, the impression cylinder and others so that only the plate cylinder can be driven. More specifically, the output from a high precision motor can be subjected to reduction through a high precision gear, steel band or the like to drive only the plate cylinder. During the recording of a high quality image, these means may be used singly or in combination.

The ejection head will now be described in more detail with reference to FIGS. 3 to 9. However, the present invention should not be construed as being limited thereto.

Figure 3:
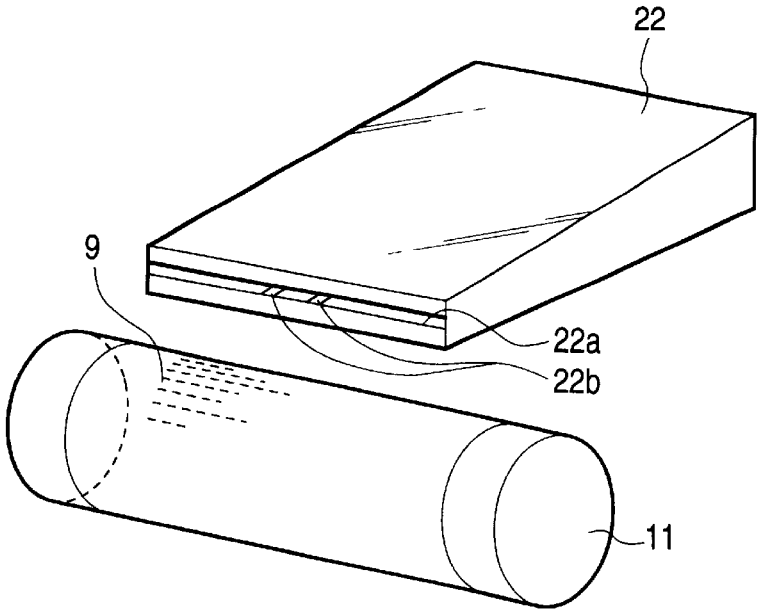
FIG. 3 is a schematic diagram illustrating the configuration of an embodiment of the head provided in the ink jet recording device used in the present invention.
Figure 4:
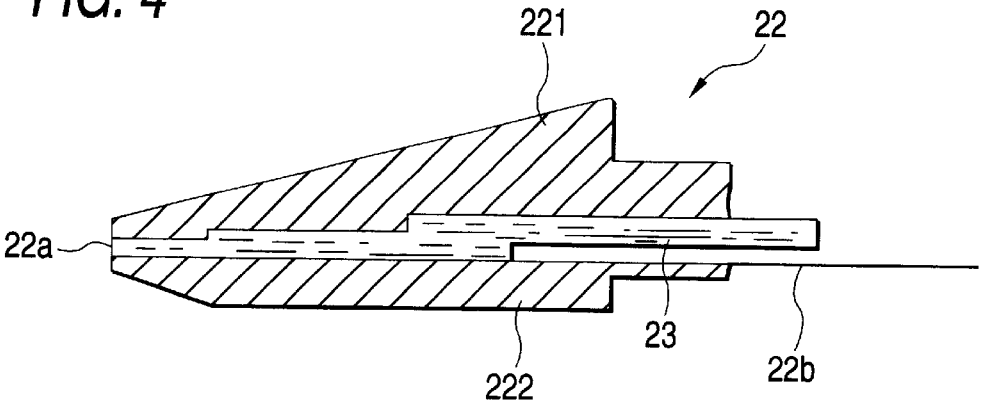
FIG. 4 is a schematic sectional view of a portion in the vicinity of the ink ejection portion of FIG. 3.

FIGS. 3 and 4 show an example of an ejection head which is installed in the ink jet recording device. The ejection head 22 has a slit interposed between an upper unit 221 and a lower unit 222, each formed by an insulating substrate, while the tip thereof forms an ejection slit 22*a*. An ejection electrode 22*b* is arranged in the slit, and the slit is filled with an ink 23 supplied from an ink supplying device. Examples of the insulating substrate usable for the head include plastics, glass and ceramics. The ejection electrode 22*b* is formed on the lower unit 222 made of an insulating substrate according to a known method. For instance, the top surface of the lower unit 222 may be provided with a conductive material such as aluminum, nickel, chromium, gold or platinum using a technique such as vacuum deposition, sputtering or electroless plating, and then the conductive material coating is covered with a photoresist. The photoresist is exposed to light via a desired electrode pattern and developed to form a photoresist pattern in the form of the ejection electrode 22*b*. Then, the conductive material coating undergoes etching, mechanical removal or a combination thereof to form the ejection electrode 22*b*.

During operation of the ejection head 22, a voltage is applied to the ejection electrode 22*b* in accordance with digital signals corresponding to image pattern information. As shown in FIG. 3, the ejection electrode 22*b* is arranged facing the plate cylinder 11 so as to constitute a counterelectrode, and the printing plate precursor 9 is mounted on the plate cylinder as the counterelectrode. Upon application of voltage, a circuit is formed between the ejection electrode 22*b* and the plate cylinder 11 acting as the counterelectrode, and the oil-based ink 23 is ejected from the ejection slit 22*a* of the ejection head 22 to form an image on the printing plate precursor 9 mounted on the plate cylinder 11 as the counterelectrode.

In order to form a high-quality image, it is preferred that the tip of the ejection electrode 22*b* is made as small as possible. The tip of the electrode is ordinarily shaped so as to have a width of from 5 to 100 $\mu$m, although the tip width may be varied depending on conditions.

For instance, a dot having a diameter of 40 $\mu$m can be formed on the printing plate precursor 9 when an ejection electrode 22*b* having a tip width of 20 $\mu$m is used, the space between the ejection electrode 22*b* and the plate cylinder 11 as a counterelectrode is adjusted to 1.0 mm, and a voltage of 3 kV is applied for 0.1 millisecond between these electrodes.

Figure 5:
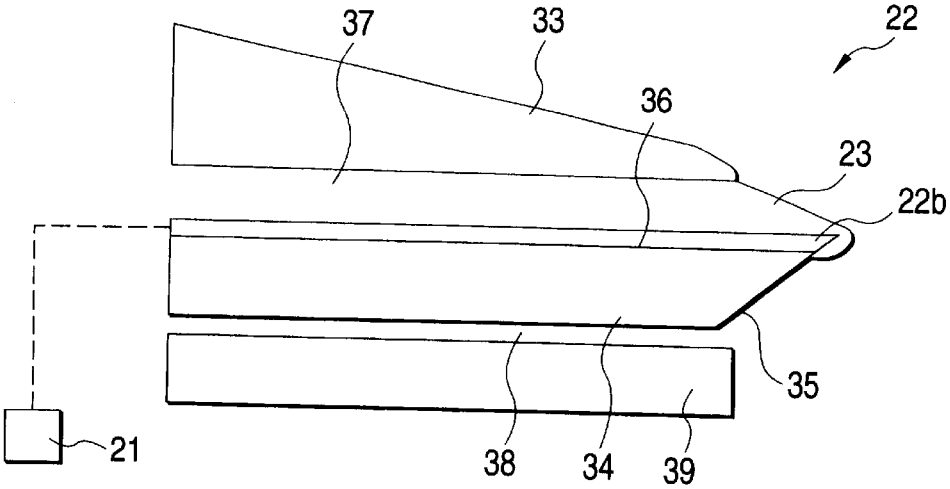
FIG. 5 is a schematic sectional view of a portion in the vicinity of the ink ejection portion of another embodiment of the head provided in the ink jet recording device used in the present invention.
Figure 6:
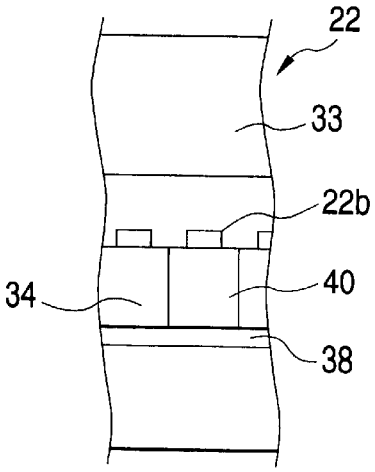
FIG. 6 is a schematic front view of a portion in the vicinity of the ink ejection portion of FIG. 5.

FIGS. 5 and 6 respectively show a schematic cross-sectional view and a schematic front view of the vicinity of an ink ejector of another example of the ejection head. Reference numeral 22 in these figures indicate the ejection head. The head has a first insulating substrate 33 of a tapered shape. A second insulating substrate 34 is set facing to and apart from the first insulating substrate 33. An end portion of the second insulating substrate 34 has a slope 35. The first and second insulating substrates are each made of, e.g., plastics, glass or ceramics. On a top surface 36 of the second insulating substrate 34, which makes a sharp angle with the slope 35, a plurality of ejection electrodes 22*b* are provided for forming an electrostatic field in the ejector. The tips of the ejection electrodes 22*b* extend to the vicinity of the tip of the top surface 36, and protrude beyond the tip of the first insulating substrate 33, thereby forming the ejectors. An ink inflow course 37, defining a pathway for supplying ink 23 to the ejector, is formed between the first and second insulating substrates 33 and 34, and the ink recovery course 38 is formed on the underside of the second insulating substrate 34. The ejection electrodes 22*b* are formed using a conductive material such as aluminum, nickel, chromium, gold or platinum on the top surface of the second insulating substrate 34 in a conventional manner as described above. The respective ejection electrodes 22*b* are constructed so as to be in an electrically insulated state. A suitable length for the tip of the ejection electrode 22*b* that protrude beyond the tip of the first insulating substrate 33 is 2 mm or less. A reason why such a range of protrusion is preferred is that, if the protrusion is too long, it is difficult for the ink meniscus to reach the tip of ejector, resulting in difficulty in ejection of the ink and a decrease in maximum recording frequency. Also, it is preferred that the space between the first and second insulating substrates 33 and 34 be from 0.1 to 3 mm. A reason why this range is preferred for the space is that too narrow a space makes supply of the ink difficult, resulting in difficulty in ejection of the ink and a decrease in maximum recording frequency while, on the other hand, too wide a space makes the meniscus unstable, resulting in inconsistent ejection of the ink.

The ejection electrode 22*b* is connected to the arithmetic and control unit 21. In carrying out recording, a voltage is applied to the ejection electrode in accordance with image information signals from the arithmetic and control unit 21, and thereby the ink on the ejection electrode is ejected to perform image formation on a printing plate precursor (not shown) arranged to be facing to the ejector. The ink inflow course 37 is connected to a device for sending ink from an ink supplying device (not shown) on the side opposite to the ink ejector. Further, a backing 39 is arranged apart from and facing toward the underside, which is the reverse of the ejection electrode side, of the second insulating substrate 34 to form an ink recovery course 38 between the backing and the underside of the second insulating substrate 34. It is preferred that the width of the space of the ink recovery course 38 be at least 0.1 mm. This is because too small a space makes the recovery of ink difficult, resulting in ink leakage. The ink recovery course 38 is connected to an ink recoverer, which is attached to the ink supplying device (not shown). If a uniform ink flow over the ejector is required, grooves 40 may be provided between the ejector and the ink recoverer. FIG. 6 is a front view showing the vicinity of the ejector of an ejection head. As shown in FIG. 6, a plurality of grooves 40 are provided in the slope of the second insulating substrate 34 from the vicinity of the borders with the respective ejection electrodes 22 to the ink recovery course 38. The grooves 40 are aligned in the lengthwise direction of the ink jet electrode 22*b* , and have a function for conducting by capillary action a predetermined amount of ink, depending on the opening diameter, present in the vicinity of the tip of each ejection electrode from the respective openings on the side of ejection electrodes 22*b* into the ink recovery course 38. Thus, the grooves 40 function to form an ink flow having a certain thickness in the vicinity of the tip of each ink jet electrode. The groove 40 may have any shape as far as the grooves can provide the desired capillary action. However, it is especially desirable that the width of the grooves is from 10 to 200 $\mu$m and the depth thereof is from 10 to 300 $\mu$m. The grooves 40 are provided in a number sufficient for forming a uniform ink flow over the entire ejection head.

In order to effect formation, e.g., printing of a high-quality image, it is preferred that the tip of the ejection electrode 22*b* be made as small as possible. The tip of the electrode is ordinarily shaped so as to have a width of from 5 to 100 $\mu$m, although the tip width may be varied depending on conditions.

Figure 7:
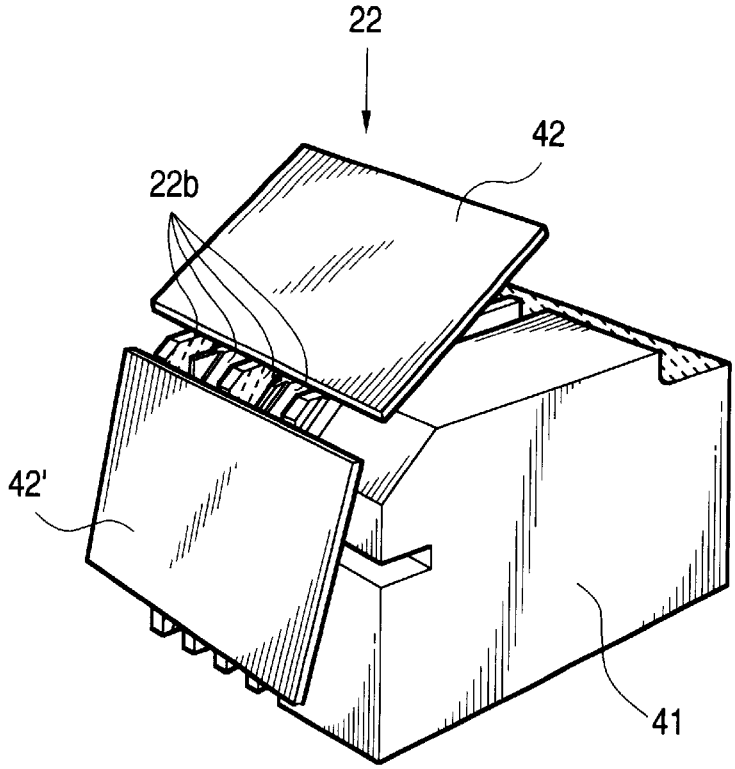
FIG. 7 is a schematic diagram illustrating the configuration of an essential part of a further embodiment of the head provided in the ink jet recording device used in the present invention.

Still another example of the ejection head for use in the present invention is shown in FIGS. 7 and 8. FIG. 7 is a schematic diagram illustrating only a portion of the head. The recording head 22, as shown in FIG. 7, has a main body 41 made of an insulating material such as plastics, ceramics or glass, and meniscus regulating panels 42 and 42'. Reference numeral 22*b* in FIG. 7 indicates an ejection electrode to which a voltage is applied to form an electrostatic field in the ejector. The main body 41 of the head is further illustrated in detail with reference to FIG. 8 wherein the regulating panels 42 and 42' are removed from the ejection head. The main body 41 of the head has a plurality of ink grooves 43 cut perpendicularly to the edge thereof for the purpose of ink circulation. The grooves 43 each may have any shape so far as the grooves can provide a suitable capillary action sufficient to form a uniform ink flow. However, it is especially desirable that the width of the groove be from 10 to 200 $\mu$m and the depth thereof be from 10 to 300 $\mu$m. Ejection electrodes 22*b* are provided in respective ones of the grooves 43. In each of the grooves 43 the ejection electrode 22*b* may be arranged so as to cover the entire surface of the groove or it may be formed on only a portion of the groove using a conductive material such as aluminum, nickel, chromium, gold or platinum, according to a well-known method as described in the above-described example of the head. Additionally, the ejection electrodes are electrically isolated from one another. Two ink grooves adjacent to each other form one cell, and a separator wall 44 positioned in the center of the cell has an ejector 45 or 45' in the tip. The separator wall 44 is made thinner in the ejector 45 or 45' than in other portions thereof, and the ejector is sharpened. The main body of the head having the configuration method such as mechanical processing or etching of a block of insulating material, or molding of an insulating material. It is desirable that the separator wall in the ejector have a thickness of from 5 to 100$\mu$m and the sharpened tip thereof have a radius of curvature of from 5 to 50 $\mu$m. Further, the tip of the ejector may be slightly cut off as shown in the ejector 45' . In the figure, only two cells are depicted for ease of illustration. A separator wall 46 is disposed between cells. The tip 47 of the wall 46 is cut off so as to be set back compared with the ejectors 45 and 45' . The ink is flowed into the ejection head via ink grooves from the direction indicated by an arrow I with from an ink supplying device (not shown), and thereby supplied to the ejectors. Further, the excess ink is recovered in the direction indicated by an arrow O with an ink recoverer (not shown). As a result, fresh ink is always supplied to each ejector. A plate cylinder holding a printing plate precursor on the surface thereof (notshown) is arranged so as to face the ejector. While maintaining such a condition, a voltage corresponding to the image information is applied to the ejection electrode, and ink is ejected from the ejector to form an image on the printing plate precursor.

Still another example of the ejection head is described with reference to FIG. 9. As shown in FIG. 9, the ejection head 22 has a pair of nearly rectangular plate-shaped support members 50 and 50'. Each of these support members 50 and 50' is made of an insulating plastic, glass or ceramic plate having a thickness of from 1 to 10 mm, and in one surface thereof there are formed a plurality of rectangular grooves 51 or 51' extending parallel to one another. Each of the grooves 51 and 51' desirably has a width of from 10 to 200 $\mu$m and a depth of from 10 to 300 $\mu$m. In each of the grooves, an ejection electrode 22*b* is formed so as to cover the whole or only a portion of the groove surface. The formation of a plurality of grooves 51 or 51' in one surface of each support member 50 or 50' results in the formation of rectangular separator walls 52 between respective pairs of grooves. The support members 50 and 50' are placed together so that the surfaces thereof in which no grooves are formed are brought into contact with each other. Specifically, the ejection head 22 has a plurality of grooves for distribution of ink over the periphery thereof. The grooves 51 formed in the support member 50 are coupled to corresponding ones of the grooves 51' formed in the support member 50' by way of the rectangular portion 54 of the ejection head 22. Each rectangular portion 54 that couples together two corresponding grooves is set back a predetermined distance (e.g., 50 to 500 $\mu$m) from the top end portion 53 of the ejection head. In other words, each of the separator walls 52 adjoining each rectangular portion 54 on both sides is disposed so that the top end 55 thereof protrudes beyond the adjacent rectangular portions 54. Also, a guide protrusion 56 made of an insulating material as described above is attached so as to protrude beyond each rectangular portion 54, thereby forming the ejector. When ink is circulated through the ejection head 22 having the structure as described above, the ink is supplied to each rectangular portion 54 via a respective groove 51 formed at the periphery of the support member 50, and the ink is discharged via the grooves 51' formed in the support member 50' opposite the support member 50. In this case, the ejection head 22 is inclined at a predetermined angle so that the ink supply side (the support member 50) is situated upward and the ink discharge side (the support member 50') is situated downward. By circulating the ink through the ejection head 22 in such a manner, the ink passing across each rectangular portion 54 flows forward along the guide protrusions 56 to form an ink meniscus in the vicinity of the rectangular portion 54 and the protrusion 56. A plate cylinder holding a printing plate precursor on the surface thereof (not shown) is arranged so as to face the ejector. With independent ink meniscuses formed on the respective rectangular portions 54, a voltage corresponding to the image information is applied to the ejection electrode, and the ink is ejected from the ejector to form an image on the printing plate precursor. A cover may be attached along the periphery of each of the support members 50 and 50' to cover the grooves, thereby forming pipe-shaped ink flow courses along the periphery of each of the support members 50 and 50'. In such a case, since the ink can be made to circulate by way of these ink flow courses, it is not necessary to incline the ejection head 22.

The ejection heads 22 as shown in FIGS. 3 to 9 can also be provided with a maintenance device such as a cleaner if desired. For instance, in a case where recording has been suspended for a certain period or problems in image quality occur, a device for wiping the tip of the ejection head with a flexible brush or cloth, a device for circulating the ink solvent alone, and a device for exerting suction on the ejector while supplying or circulating the ink solvent alone can be adopted singly or in combination, whereby satisfactory recording conditions can be maintained. In order to prevent the ink from solidifying inside the ejection head, it is also effective to cool the ejection head, thereby reducing evaporation of the ink solvent. Further, if the contamination of the head is severe, a method of suctioning ink from the ejector, a method of blowing air in the ink flow course, and a method of applying ultrasonic waves to the head while immersing the head in an ink solvent are also effective. These methods can be used alone or in combination.

The cleaning device according to the present invention will be further described in connection with FIG. 14.

The cleaning device is represented by the reference numeral 60. In the operation of the cleaning device 60, a conveyance mechanism (not shown) carries the recording head 22 to the cleaning device 60. Thereafter, at least the ejection tip of the recording head 22 is dipped in a cleaning fluid 57. A voltage having the same polarity as that of the solid chargeable component in the ink is then applied to the ejection tip of the recording head 22 from an electric supply 59 via a conductor 591. The other conductor 592 from the electric supply 59 is connected to a metallic chassis as a cleaning fluid container 58. In this circuit arrangement, the solid chargeable component is repelled by the ejection electrode and thus is completely removed.

In this case, the voltage to be applied may be an ac voltage. Alternatively, an ac voltage may be imposed on a voltage having the same polarity as that of the solid chargeable component. In particular, when an ac voltage is imposed on a dc voltage, the solid chargeable component undergoes vibration, enhancing the cleaning effect.

In addition to the application of voltage, ultrasonic wave may be applied to further enhance the cleaning effect. As the cleaning fluid there may be used any compound so far as it doesn't attack the recording head. In practice, however, as such a fluid there is preferably used an ink solvent or ink itself.

Figure 14:
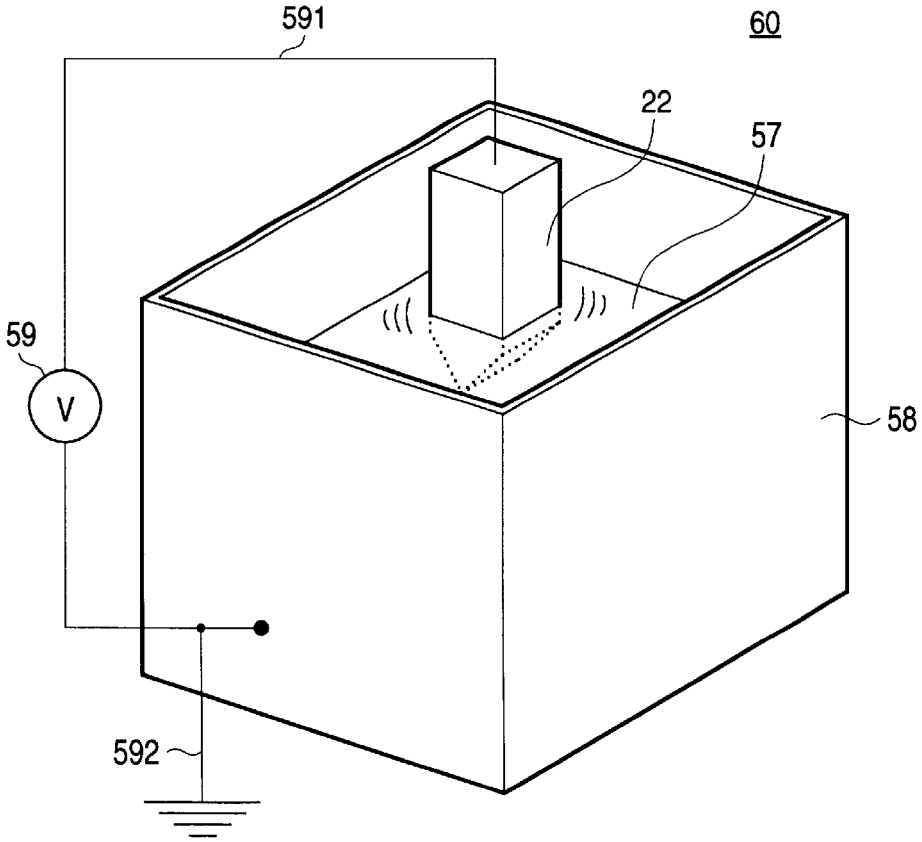
FIG. 14 is a diagram illustrating the recording head cleaning device according to the present invention.
Figure 15:
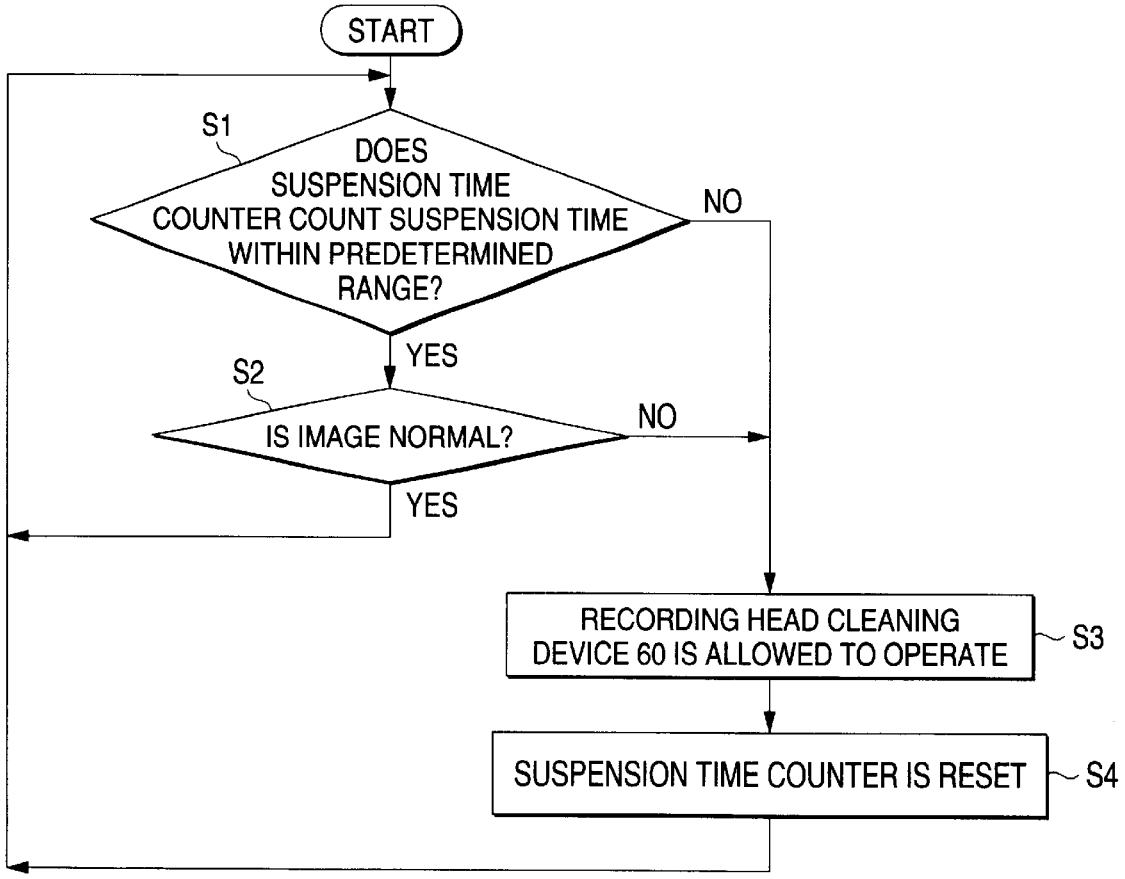
FIG. 15 is a flow chart illustrating the operation of the recording head cleaning device of FIG. 10.

FIG. 15 is a flow chart illustrating the operation of the recording head cleaning device of FIG. 14. The cleaning device 60 operates when the printing apparatus is kept suspended over an extended period of time and when there occurs problems with image or image quality. A suspension time counter (not shown) for counting the suspension of the printing apparatus counts the suspension time. When a predetermined period of time (e.g., 1 month) is passed (step 1), the cleaning device 60 is actuated (step 3).

In accordance with a known method, an image or image quality is always detected, e.g., by a CCD camera. CPU then compares the image quality thus detected with a reference image quality stored in a memory. When the results of the comparison show that there occur problems with the image or image quality (step 2), the cleaning device 60 is actuated (step 3) even if the suspension time of the printing apparatus falls within a predetermined period of time.

When the cleaning device 60 is actuated, cleaning is effected by dipping at least the ejection tip of the recording head 22 in the cleaning fluid 57 as shown in FIG. 14 mentioned above.

After the termination of cleaning, the suspension time counter for counting the suspension of the printing apparatus is reset, (step 4) and the counting of the suspension of the printing apparatus is resumed.

A specific example will be described hereinafter with reference to an on-press recording type multi-color single-sided lithographic printing apparatus.

FIG. 10 is a schematic diagram illustrating the entire configuration of an on-press recording type four-color lithographic printing apparatus. As shown in FIG. 10, the four-color single-sided printing apparatus essentially comprises four plate cylinders 11, four blanket cylinders 12 and four impression cylinders 13 of the monochromatic single-sided printing apparatus shown in FIG. 1 arranged for each of four colors such that printing is effected on the same surface of printing paper P. Though not shown, the delivery of printing paper from an impression cylinder to another as shown by K is carried out by a known delivery cylinder or the like. Although detailed description is omitted, as can be easily seen in the example of FIG. 10, other multi-color single-sided printing apparatus each essentially comprise a plurality of plate cylinders 11, blanket cylinders 12 and impression cylinders 13 arranged for each color such that printing is effected on the same surface of printing paper P. In the case where only one printing plate is prepared for each plate cylinder, there are provided plate cylinders and blanket cylinders in an amount corresponding to the number of colors to be printed. (Such a printing apparatus is referred to as "unit type printing apparatus") On the other hand, in the case where the present invention is implied in the form of a common impression cylinder type printing apparatus which shares one impression cylinder having a diameter which is an integral multiple of the diameter of the plate cylinder among plate cylinders and blanket cylinders in an amount corresponding to the number of a plurality of colors, the arrangement may be such that one impression cylinder is shared by plate cylinders and blanket cylinders in an amount corresponding to the number of colors to be printed. Alternatively, the arrangement may be such that the total number of plate cylinders and blanket cylinders corresponds to the number of colors to be printed. In this arrangement, the delivery of printing paper between adjoining common impression cylinders may be carried out by the foregoing known delivery cylinder or the like. On the other hand, in the case where a plurality of color printing plates are prepared for each plate cylinder, plate cylinders and blanket cylinders are necessary in an amount corresponding to the value obtained by dividing the number of colors to be printed by the number of printing plates per plate cylinder. For example, when two color printing plates are prepared per plate cylinder, a press comprising two plate cylinders and two blanket cylinders can be used to effect four-color printing on one side of printing paper. In this case, the diameter of the impression cylinder is the same as that of the plate cylinder for one color. If necessary, the impression cylinder is provided with a means for holding printing paper until printing of the required number of colors is completed. The delivery of printing paper can be accomplished by a known delivery cylinder or the like. In the case of a press having two plate cylinders having the foregoing two color printing plate precursors formed thereon and two blanket cylinders, when one of the two impression cylinders rotates twice holding printing plate, two-color printing is effected. Subsequently, printing paper is delivered between the impression cylinders. When the other impression cylinder rotates twice holding printing paper, another two-color printing is effected, thereby completing four-color printing. The number of impression cylinders to be installed may be the same as that of plate cylinders. Several plate cylinders and blanket cylinders may have one impression cylinder in common.

On the other hand, in the case where the present invention is implicated in the form of on-press recording type multi-color double-sided lithographic printing apparatus, a known printing paper inverting means is provided in at least one gap between adjacent impression cylinders in the foregoing unit type printing apparatus or in at least one gap between adjacent impression cylinders in an arrangement having a plurality of the foregoing common impression cylinder type printing apparatus. Alternatively, a plurality of the plate cylinders 11 and blanket cylinders 12 in the monochromatic single-sided printing apparatus shown in FIG. 1 are provided. In the structure as shown in FIG. 1, in the case where only one color printing plate is prepared for each plate cylinder, there are provided plate cylinders and blanket cylinders in an amount corresponding to the number of colors to be printed on both surfaces of printing paper.

On the other hand, in the case where a plurality of color printing plates are prepared for each plate cylinder as mentioned above, the required number of plate cylinders, blanket cylinders and impression cylinders can be reduced.

Further, in the case where several plate cylinders and blanket cylinders have one impression cylinder in common, the required number of impression cylinders may be reduced, too. If desired, the impression cylinder is provided with a means for holding printing paper until the desired number of colors are printed. The detail of the configuration of this system can be easily inferred from the foregoing example of on-press recording type multi-color single-sided lithographic printing apparatus and thus will not be described hereinafter.

The embodiment of implication of the on-press recording type lithographic printing apparatus according to the present invention has been described with reference to an example of sheet-feed press. In the case where the present invention is implicated as an on-press recording type multi-color WEB (paper roll) lithographic printing machine, on the other hand, the foregoing unit type or common impression cylinder type printing machine can be used to advantage. In the case where the present invention is implicated as an on-press recording type multi-color WEB (paper roll) double-sided printing machine, both the unit type and common impression cylinder type printing machine can be realized by arranging a plurality of structures each comprising a known WEB inverting means provided in at least one gap between adjacent impression cylinders such that printing is effected on both surfaces of printing paper P. Most preferred among on-press recording type multi-color WEB (paper roll) double-sided printing apparatus is BB (blanket-to-blanket) type printing machine. This type of printing machine comprises one plate cylinder and blanket cylinder (no impression cylinder) for one color to be printed on one surface of WEB and one plate cylinder and blanket cylinder (no impression cylinder) for the same color to be printed on the other surface of WEB, said blanket cylinders being pressed against each other during printing. This structure is provided in an amount corresponding to the number of colors to be printed. WEB passes through the gap between the blanket cylinders which are pressed against each other during printing to perform multi-color double-sided printing.

Another example of the on-press recording type lithographic printing apparatus comprises two plate cylinders per blanket cylinder, whereby printing is effected on one of the two plate cylinders while image recording is being effected on the other. In this case, it is desirable that the plate cylinder on the part of image recording be driven while being mechanically separated off from the blanket cylinder. In this manner, image recording is made possible without suspending the operation of the press. As can be easily inferred, this mechanism can be applied to on-press recording type multi-color single-sided lithographic printing apparatus and on-press recording type multi-color double-sided lithographic printing apparatus.

The plate material (printing plate precursor) which can be used in the present invention will be described in greater detail below.

As the printing plate precursor there may be used a metal plate such as aluminum- or chromium-plated steel plate. In particular, an aluminum plate, which can be grained or anodized to have an excellent surface water retention and abrasion resistance, is desirable. As a more inexpensive printing plate precursor there may be used a printing plate precursor having a water-resistant support such as paper subjected to a water-resistant treatment, a plastic film or paper laminated with plastic, having provided thereon an image-receiving layer. The thickness of the image-receiving layer is ordinarily in a range of from 5 to 30 $\mu$m.

The image-receiving layer includes a hydrophilic layer including an inorganic pigment and a binder and a layer capable of being rendered hydrophilic by an oil-desensitizing treatment.

The inorganic pigment used in the hydrophilic image-receiving layer include clay, silica, calcium carbonate, zinc oxide, aluminum oxide and barium sulfate. The binder used includes a hydrophilic binder, for example, polyvinyl alcohol, starch, carboxymethyl cellulose, hydroxyethyl cellulose, casein, gelatin, a salt of polyacrylic acid, polyvinyl pyrrolidone and a methyl ether-maleic anhydride copolymer. Further, in order to impart water-resistance to the image-receiving layer, a melamine formaldehyde resin, a urea formaldehyde resin or other crosslinking agents may be added thereto if desired.

The image-receiving layer to which an oil-desensitizing treatment is applied includes, for example, a layer containing zinc oxide and a hydrophobic binder.

The zinc oxide used in the image-receiving layer according to the present invention is any of zinc oxide, zinc white, wet-type zinc white, and activated zinc white as commercially available, as described in Nippon Ganryo Gijutsu Kyokai, ed., "Shinban Ganryo Binran (New Edition of Pigment Handbook)", pp. 319, Kabushiki Kaisha Seiundo (1968).

Specifically, depending on the starting materials and production method, zinc oxide is classified into two groups, that produced by a wet method and that produced by a dry method, which groups are further subclassified into zinc oxide produced by the "French" method (indirect method) or "American" method (direct method). Suitable examples of zinc oxide include those commercially available from Seido Kagaku Kogyo K.K., Sakai Chemical Industry Co., Ltd., Hakusui Chemical Industries, Ltd., Honjo Chemical K.K., Toho Zinc Co., Ltd., and Mitsui Mining & Smelting Co., Ltd.

Specific examples of the resin to be used as binder include styrene copolymer, methacrylate copolymer, acrylate copolymer, vinyl acetate copolymer, polyvinyl butyral, alkyd resin, epoxy resin, epoxyester resin, polyester resin, and polyurethane resin. The resins may be employed singly or in combination of two or more thereof.

The content of the resin in the image-receiving layer is from 9/91 to 20/80 in terms of a weight ratio of resin/zinc oxide.

Examples of the oil-desensitizing solution which has heretofore been used for the oil-desensitizing of the image-receiving layer containing zinc oxide include those conventionally known, for example, a treating solution containing a cyan compound such as ferrocyanate or ferricyanate as the main component, a cyan-free treating solution containing an ammine cobalt complex, phytic acid or a derivative thereof, or a guanidine derivative as the main component, a treating solution containing an inorganic or organic acid capable of forming a chelate with an zinc ion as the main component, and a treating solution containing a water-soluble polymer.

For instance, treating solutions containing a cyan compound include those described, e.g., in JP-B-44-9045 (The term "JP-B" as used herein means an "examined Japanese patent application"), JP-B-46-39403, JP-A-52-76101, JP-A-57-107889 and JP-A-54 -117201.

The surface of the printing plate material opposed to the image-receiving layer preferably has a Beck smoothness of from 150 to 700 (sec/10 cc). The resulting printing plate allows fair transfer without sliding or slipping on the plate cylinder.

Beck smoothness can be measured by means of a Beck smoothness testing machine. In operation of such a Beck smoothness testing machine, a specimen is pressed against a highly smoothened circular glass plate having a hole at the center thereof at a constant pressure of 1 kgf/cm$^2$ (9.8 N/cm$^2$). Under these conditions, the time required for a predetermined amount (1 cc) of air to pass through the gap between the surface of the glass plate and the specimen under reduced pressure is then measured.

The oil-based ink which can be used in the present invention is described in more detail below.

The oil-based ink used in the present invention is a dispersion comprising resin particles which are solid and hydrophobic at least at ordinary temperature dispersed in a nonaqueous solvent having an electrical resistance of $10^9$ Ω-cm or more and a dielectric constant of 3.5 or less.

The surface tension of the oil-based ink is not specifically limited. In practice, however, the surface tension of the oil-based ink which can be used in the present invention is 35 dyne/cm or less, preferably from 15 dyne/cm to 35 dyne/cm, more preferably from 16 dyne/cm to 30 dyne/cm. When the surface tension of the oil-based ink is too high, the resulting oil-based ink may exhibit a deteriorated ejectability. On the contrary, when the surface tension of the oil-based ink is too low the resulting oil-based ink can easily spill from the ejection head and may exhibit a deteriorated stability.

The viscosity of the oil-based ink is not specifically limited. In practice, however, the viscosity of the oil-based ink which can be used in the present invention is 15 cP or less, preferably from 0.4 cP to 15 cP, more preferably from 0.5 cP to 10 cP. When the viscosity of the oil-based ink is too high, the resulting oil-based ink may exhibit a deteriorated ejectability. When the viscosity of the oil-based ink is too low, the resulting oil-based ink can easily spill from the ejection head and may exhibit a deteriorated stability.

Further, the particle charge distribution of the oil-based ink (proportion of electric charge on particles in electric charge on the entire ink) is not specifically limited. In practice, however, the particle charge distribution of the oil-based ink which can be used in the present invention is 10% or more, preferably 30% or more, more preferably 40% or more. When the particle charge distribution of the oil-based ink is too low, the resulting oil-based ink can hardly form condesates and thus may exhibit an insufficient press life.

The particle charge distribution is defined by (electrical conductivity of entire ink—electrical conductivity of supernatant liquid obtained by centrifugal separation of ink (at 15,000 rpm for 30 minutes))/electrical conductivity of entire ink×100%. For the evaluation of the foregoing particle charge distribution, electrical conductivity is measured at a frequency of 1 kHz and an applied voltage of 5 V.

Preferred examples of the nonaqueous solvent having an electrical resistance of $10^9$ Ω-cm or more and a dielectric constant of 3.5 or less include straight-chain or branched aliphatic hydrocarbons, alicyclic hydrocarbons, aromatic hydrocarbons and halogenated products of these hydrocarbons. Specific examples thereof include hexane, heptane, octane, isooctane, decane, isodecane, decaline, nonane, dodecane, isododecane, cyclohexane, cyclooctane, cyclodecane, benzene, toluene, xylene, mesitylene, IsoparC, IsoparE, IsoparG, Isopar H and Isopar L (Isopar: tradename, a product of Exxon Corp.), Shellsol 70 and Shellsol 71 (Shellsol: tradename, product of Shell Oil Corp.), Amsco OMS and Amsco 460 Solvent (Amusco: tradename, product of American Mineral Spirits Corp.), and silicone oils. They can be used singly or as a mixture of two or more thereof. As to the nonaqueous solvent, the upper limit of the electrical specific resistance value is of the order of $10^{16}$ Ω-cm, and the lower limit of the dielectric constant value is about 1.9.

The reason why the range of the nonaqueous solvent is restricted as described above is explaned below. If the electrical resistance of the nonaqueous solvent used is too far below the above-described range, the resin particles, etc. can hardly be concentrated, making it impossible to obtain a sufficient press life. On the other hand, when the dielectric constant of the nonaqueous solvent used is too far above the above-described range, the electric field in the ink can be easily relaxed, making it difficult for the ink to be ejected.

As the resin particles to be dispersed in the nonaqueous solvent as described above are hydrophobic resin particles which are solid at temperature of 35° C. or less and have good affinity with the nonaqueous solvent. As such a hydrophobic resin, a resin (O) having a glass transition temperature of from −5° C. to 110° C. or a softening temperature of from 33° C. to 140° C. is preferred. The more preferable range of the glass transition temperature is from 10° C. to 100° C., and that of the softening temperature is from 38° C. to 120° C. In particular, it is preferred for the resin (P) to have a glass transition temperature of from 15° C. to 80° C. or a softening temperature of from 38° C. to 100° C.

By using a resin having such a glass transition temperature or a softening temperature as described above, the affinity of each resin particle with the image-receiving surface of the printing plate precursor is enhanced and the resin particles are firmly bonded with each other on the printing plate precursor. Thus, the adhesion of the ink image to the printing plate precursor is increased and the press life is improved. On the contrary, if the glass transition temperature or a softening temperature of the resin used is beyond the upper and lower limits specified above, the affinity of each resin particle with the image-receiving surface of the printing plate precursor may be lowered and the bond between resin particles may be weakened.

The weight-average molecular weight (Mw) of the resin (P) is preferably from $1\times10^3$ to $1\times10^6$, more preferably from $5\times10^3$ to $8\times10^5$, and still more preferably from $1\times10^4$ to $5\times10^5$.

Specific examples of such a resin (P) include olefin homopolymers and copolymers (such as polyethylene, polypropylene, polyisobutylene, ethylene-vinyl acetate copolymer, ethylene-acrylate copolymer, ethylene-methacrylate copolymer and ethylene-methacrylic acid copolymer), vinyl chloride copolymers (such as polyvinyl chloride and vinyl chloride-vinyl acetate copolymer), vinylidene chloride copolymers, vinyl alkanoate homopolymers and copolymers, allyl alkanoate homopolymers and copolymers, homopolymers and copolymers of styrene and derivatives thereof (such as butadiene-styrene copolymer, isoprene-styrene copolymer, styrene-methacrylate copolymer and styrene-acrylate copolymer), acrylonitrile copolymers, methacrylonitrile copolymers, alkyl vinyl ether copolymers, acrylate homopolymers and copolymers, methacrylate homopolymers and copolymers, itaconic acid diester homopolymers and copolymers, maleic anhydride copolymers, acrylamide copolymers, methacrylamide copolymers, phenol resins, alkyd resins, polycarbonate resins, ketone resins, polyester resins, silicone resins, amide resins, hydroxyl and carboxyl-modified polyester resins, butyral resins, polyvinyl acetal resins, urethane resins, rosin resins, hydrogenated rosin resins, petroleum resins, hydrogenated petroleum resins, maleic acid resins, terpene resins, hydrogenated terpene resins, chroman-indene resins, cyclized rubber-methacrylate copolymers, cyclized rubber-acrylate copolymers, copolymers containing a heterocyclic ring containing no nitrogen atom (as the heterocyclic ring, e.g., furan ring, tetrahydrofuran ring, thiophene ring, dioxane ring, dioxofuran ring, lactone ring, benzofuran ring, benzothiophene ring and 1,3-dioxetane ring), and epoxy resins.

It is desirable for the resin particles to be contained in the oil-based ink of the invention in an amount of from 0.5 to 20% by weight based on the total ink content. If the amount of the resin particles is too low, the affinity of the ink with the image-receiving layer of the printing plate precursor is insufficient, and, as a result, the ink may not form images of good quality and the press life tends to decrease. On the other hand, if the proportion of resin particles is increased beyond the above-described range, it may be difficult to form a homogeneous dispersion, and, as a result, the ink flow through the ejection head can be nonuniform and stable ink ejection may not be achieved.

For the oil-based ink used in the present invention, it is preferred to include a coloring material together with the resin particles in order to allow easy visual inspection of the resulting printing plate.

Such a coloring material may be any of a number of pigments and dyes which have been ordinarily used in conventional oil-based ink compositions and liquid developers for electrostatic photography.

The pigment to be used has no particular restriction, and includes both inorganic and organic pigments which are ordinarily used in the field of printing. Examples of pigments usable in the oil-based ink without any restriction include carbon black, cadmium red, molybdenum red, chrome yellow, cadmium yellow, titanium yellow, chromium oxide, viridian, titanium cobalt green, ultramarine blue, Prussian blue, cobalt blue, azo pigments, phthalocyanine pigments, quinacridone pigments, isoindolidone pigments, dioxazine pigments, threne pigments, perylene pigments, perylone pigments, thioindigo pigments, quinophthalone pigments, metal complex pigments, and other conventionally known pigments.

As the dyes, oil-soluble dyes are suitable for use in the oil-based ink, with examples including azo dyes, metal complex dyes, naphthol dyes, anthraquinone dyes, indigo dyes, carbonium dyes, quinoneimine dyes, xanthene dyes, cyanine dyes, quinoline dyes, nitro dyes, nitroso dyes, benzoquinone dyes, naphthoquinone dyes, phthalocyanine dyes and metallo-phthalocyanine dyes.

The pigments and dyes may be used singly, or they can be used in appropriate combinations. It is desirable that they are contained in a proportion of from 0.01 to 5% by weight based on the total ink content.

Such a coloring material as described above may be dispersed in the nonaqueous solvent as dispersed particles separately from the resin particles, or it may be incorporated into the resin particles dispersed in the nonaqueous solvent. In the latter case, the incorporation of a pigment is ordinarily effected by coating the pigment with the resin material of resin particles to form resin-coated particles, while the incorporation of a dye is ordinarily effected by coloring the surface portion of resin particles with the dye to form colored particles.

The average diameter of the resin particles, including colored particles, dispersed in the nonaqueous solvent is preferably from 0.05 $\mu$m to 5 $\mu$m, more preferably from 0.1 $\mu$m to 1.0 $\mu$m, further more preferably from 0.1 $\mu$m to 0.5 $\mu$m. The diameter of the particles is determined with a particle size analyzer, CAPA-500 (tradename, manufactured by Horida Ltd.).

The nonaqueous dispersion of resin particles used in the present invention can be prepared using a well-known mechanical grinding method or a polymerization granulation method. In the mechanical grinding method, the materials for forming resin particles are mixed, molten and kneaded, if required, and directly ground into fine particles with a conventional grinder, and further dispersed in the presence of a dispersing machine (e.g., a ball mill, a paint shaker, a Keddy mill, a Dyno mill). In another mechanical grinding method, the materials for forming resin particles and a dispersion assisting polymer (a covering polymer) are kneaded in advance to form a kneaded matter, then ground into fine particles, and further dispersed in the presence of a dispersing polymer. Methods of preparing paints or liquid developers for electrostatic photography can be adopted in practice. Details of these methods are described, e.g., in "Toryo no Ryudo to Ganryo Bunsan (Flow of Paints and Dispersion of Pigments)", translated under the supervision of Kenji Ueki, Kyoritsu Shuppan (1971), Solomon, "Paint Science", Hirokawa Shoten, 1969, "Paint and Surface Coating Theory and Practice", Yuji Harasaki, "Coating no Kiso Kagaku (Elementary Course of Coating Science)", Maki Shoten (1977), etc.

For the polymerization granulation method, well-known methods for dispersion polymerization in nonaqueous media can be employed. Details of such methods are described, e.g., in *The Newest Technology of Super-Fine Polymer Particles*, Chapter 2, edited under the supervision of Soichi Muroi, CMC Shuppan (1991), *The Latest Systems for Electrophotographic Development, and Development and Application of Toner Materials*, Chapter 3, edited by Koichi Nakamura, Nippon Kagaku Joho K.K. (1985), and K. B. J. Barret, *Dispersion Polymerization in Organic Medium*, John Wiley (1975).

In order to stabilize the particles dispersed in the nonaqueous solvent, the particles are generally dispersed together with a dispersing polymer. The dispersing polymer contains repeating units soluble in the nonaqueous solvent as the main component, and a weight-average molecular weight (Mw) thereof is preferably from $1\times10^3$ to $1\times10^6$, more preferably from $5\times10^3$ to $5\times10^5$.

Suitable examples of the soluble repeating units of the dispersing polymer usable in the present invention include a polymerizing component represented by the following formula(I):

[ka-1]

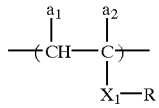

(I)

In the general formula (I), $X_1$ represents —COO—, —OCO— or —O—.

R represents an alkyl or alkenyl group having from 10 to 32 carbon atoms, preferably an alkyl or alkenyl group having from 10 to 22 carbon atoms, which may have a straight-chain or branched structure and may be substituted, although the unsubstituted form is preferred Specific examples of the alkyl group include decyl, dodecyl, tridecyl, tetradecyl, hexadecyl, octadecyl, eicosanyl, docosanyl, decenyl, dodecenyl, tridecenyl, hexadecenyl, octadecenyl or linolenyl.

The suffixes $a_1$ and $a_2$, which may be the same or different, each represents a hydrogen atom, a halogen atom (e.g., chlorine or bromine), a cyano group, an alkyl group having from 1 to 3 carbon atoms (e.g., methyl, ethyl or propyl), —COO—$Z_1$ or —$CH_2$COO—$Z_1$ [wherein $Z_1$ represents a hydrocarbon group having not more than 22 carbon atoms which may be substituted (such as an alkyl, alkenyl, aralkyl, alicyclic or aryl group).

Preferred among hydrocarbon groups represented by $Z_1$ are an unsubstituted or substituted alkyl group having from 1 to 22 carbon atoms (e.g., methyl, ethyl, propyl, butyl, hexyl, heptyl, octyl, nonyl, decyl, dodecyl, tridecyl, tetradecyl, hexadecyl, octadecyl, eicosanyl, docosanyl, 2-chloroethyl, 2-bromoethyl, 2-cyanoethyl, 2-methoxycarbonylethyl, 2-methoxyethyl or 3-bromopropyl), an unsubstituted or substituted alkenyl group having from 4 to 18 carbon atoms (e.g., 2-methyl-1-propenyl, 2-butenyl, 2-pentenyl, 3-methyl-2-pentenyl, 1-pentenyl, 1-hexenyl, 2-hexenyl, 4-methyl-2-hexenyl, decenyl, dodecenyl, tridecenyl, hexadecenyl, octadecenyl or linolenyl), an unsubstituted or substituted aralkyl group having from 7 to 12 carbon atoms (e.g., benzyl, phenetyl, 3-phenylpropyl, naphthylmethyl, 2-naphthylethyl, chlorobenzyl, bromobenzyl, methylbenzyl, ethylbenzyl, methoxybenzyl, dimethylbenzyl or dimethoxybenzyl), an unsubstituted or substituted alicyclic group having from 5 to 8 carbon atoms (e.g., cyclohexyl, 2-cyclohexylethyl or 2-cyclopentylethyl) and an unsubstituted or substituted aromatic group having from 6 to 12 carbon atoms (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl or dodecyloxylamidophenyl)].

In addition to the repeating units represented by formula (I), the dispersing polymer may contain other repeating units as copolymerizing components. The copolymerizing components may be derived from any monomers as long as they can be copolymerized with the monomers corresponding to the repeating units of formula (I).

The suitable proportion of the repeating unit represented by formula (I) in the dispersing polymer is preferably at least 50% by weight, more preferably at least 60% by weight.

Specific examples of the dispersing polymer include Dispersion Stabilizing Resin (Q-1) used in Examples described hereinafter and commercially available products, e.g., Sorprene 1205 manufactured by Asahi Chemical Industry Co., Ltd.

In preparing the resin (P) particles in the state of an emulsion (latex), it is preferred that the dispersing polymer be added prior to the polymerization.

The amount of the dispersing polymer to be added is from 1 to 50% by weight based on the particle resin (P).

In the oil-based ink employed in the present invention, it is desirable that the dispersed resin particles and colored particles (or the particles of coloring material) be electroscopic particles charged positively or negatively.

In order to impart electroscopicity to those particles, wet developer technology for electrostatic photography can be appropriately utilized. Specifically, electroscopicity can be imparted to the particles by using an electroscopic material such as charge control agent and other additives as described, e.g., in "Saikin no Denshi Shashin Genzo System to Toner Zairyou no Kaihatsu Jitsuyouka (The Latest Systems for Electrophotographic Development, and Development and Application of Toner Materials)", pp. 139–148, described above, "Denshi Shashin Gijutsu no Kiso to Oyo (The Fundamentals and Applications of Electrophotographic Techniques)", edited by Electrophotographic Society, pp. 497–505, Corona Co. (1988), and Yuji Harasaki, "Denshi Shashin (Electrophotography)", vol. 16 (No. 2), p. 44 (1977).

In addition, details of those materials are described, e.g., in British Patents 893,429, 934,038 and 1,122,397, U.S. Pat. Nos. 3,900,412 and 4,606,989, JP-A-60–179751, JP-A-60–185963 and JP-A-2–13965.

The charge control agent as described above is preferably used in an amount of from 0.001 to 1.0 parts by weight per 1,000 parts by weight of dispersing medium as a carrier liquid. Although, various kinds of additives can be further added, the total amount of additives has an upper limit because it is restricted by the electrical resistance allowable for the oil-based ink used in the present invention. More specifically, if the ink has an electrical resistance of lower than $10^9$ Ω-cm under the condition that the dispersed particles are removed from the ink, it is made difficult to obtain a continuously gradient image having a good quality. Therefore, it is necessary that the amount of each additive added be controlled within the above described limitation.

EXAMPLE

The present invention will be further described in the following examples, but the present invention should not be construed as being limited thereto.

An example of a preparation of resin particles (PL) suitable for the oil-based ink used in the present invention will be described below.

Preparation Example 1

Preparation of Resin Particle (PL-1)

A mixed solution of 10 g of Dispersion Stabilizing Resin (Q-1) having the structure illustrated below, 100 g of vinyl acetate, and 384 g of Isopar H was heated to a temperature of 70° C. under nitrogen gas stream with stirring. To the solution was added 0.8 g of 2,2'-azobis(isovaleronitrile) (abbreviated as A.I.V.N.) as a polymerization initiator, followed by reacting for three hours. Twenty minutes after the addition of the polymerization initiator, the reaction mixture became white turbid, and the reaction temperature rose to 88° C. Further, 0.5 g of the above-described polymerization initiator was added to the reaction mixture, and the reaction was carried out for two hours. Then, the temperature of the reaction mixture was raised to 100° C., and stirred for two hours to remove the unreacted vinyl acetate by distillation. After cooling, the reaction mixture was passed through a nylon cloth of 200-mesh to obtain a white dispersion. In the polymerization process, the percent polymerization was 90%. The white dispersion obtained was a latex of good monodispersity having an average particle diameter of 0.23 μm. The average particle diameter was measured by CAPA-500 (manufactured by Horiba Ltd.).

[ka-2]

Dispersion Stabilizing Resin (Q-1)

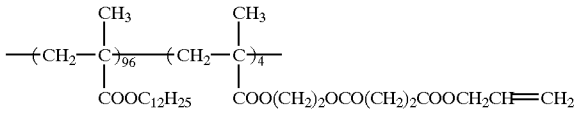

Mw: $5 \times 10^4$ (composition ratio: by weight)

A portion of the above-described white dispersion was centrifuged at a rotation of $1\times10^4$ r.p.m. for 60 minutes and the thus-precipitated resin particles were collected and dried. The weight-average molecular weight (Mw) of the resin particles was $2\times10^5$ (a GPC value in terms of polystyrene) and the glass transition temperature (Tg) thereof was 38° C.

Example 1

An oil-based ink was prepared in the following manner.

Oil-Based Ink IK-1

In a paint shaker (manufactured by Toyo Seiki K.K.), 10 g of copolymer of dodecyl methacrylate and acrylic acid (copolymerization ratio: 95/5 by weight), 10 g of nigrosine and 30 g of Shellsol 71 were placed together with glass beads, and the mixture was dispersed for four hours to prepare a fine dispersion of nigrosine.

A mixture of 60 g (as a solid basis) of Resin Particles (PL-1) prepared in Preparation Example 1, 2.5 g of the above-described dispersion of nigrosine, 15 g of FOC-1400 (tetradecyl alcohol, produced by Nissan Chemical Industries, Ltd.) and 0.08 g of copolymer of octadecene and semimaleic acid hexadecylamide was diluted with one liter of Isopar G, thereby preparing oil-based black ink.

An ink tank of an ink jet recording device of an on-press recording type lithographic printing apparatus (see FIGS. 1 and 2; free of cleaning device 60 and head protective device 20) was filled with 2 liters of Oil-Based Ink (IK-1) thus prepared. A 900 dpi 64-channel multiple channel head as shown in FIG. 3 was used as an ejection head. A drop-in type heater and stirring blades were installed for controlling the ink temperature in the ink tank. The ink temperature was set at 30° C., and temperature control was carried out with a thermostat while rotating the stirring blades at 30 r.p.m. Rotation of the stirring blades was also utilized for preventing precipitation and aggregation. Further, a portion of the ink flow course was made transparent, which portion was arranged between a light emission diode (LED) and a light detector, concentration control of the ink was carried out by feeding diluent for the ink (Isoper G) or concentrated ink (the solid concentration of which was adjusted to twice that of Oil-Based Ink (IK-1)). An aluminum plate having a thickness of 0.12 mm which had been subjected to graining and anodizing treatment was used as a printing plate precursor. The printing plate precursor was mounted on the plate cylinder with the head and end thereof being gripped by a mechanical device provided on the plate cylinder. With the dampening water supplier, the printing ink supplier and the blanket cylinder being separated from the printing plate precursor, dust on the printing plate precursor surface was removed by air-pump suction. Then, the ejection head was moved close to the printing plate precursor until it reached the recording position. Image data to be printed was transmitted to an arithmetic and control unit. While the 64-channel ejection head was being carried by the rotation of the plate cylinder, the oil-based ink was ejected onto the aluminum printing plate to form an image. During this procedure, dust on the printing plate was optically sensed to produce an output signal by which air pump suction was then effected to remove dust from the surface of the printing plate. Further, the shape of meniscus at the tip of the head was sensed to monitor the attachment of foreign matters to the head. Moreover, the relative vibration of the head and the plate cylinder was sensed by an accelerometer mounted thereon to sense vibration. During ejection, the ejection electrode of the ejection head had a tip width of 10 μm, and the distance between the head and the printing plate precursor was kept at 1 mm by utilizing output from an optically gap-detecting device. A voltage of 2.5 kV was always applied as a bias voltage, and a pulse voltage of 500 V was further superimposed for each ejection of ink. The duration of pulse voltage was changed stepwise from 0.2 millisecond to 0.05 millisecond in 256 steps, thereby changing the dot area for recording. The image thus formed on the printing plate precursor had no defects due to dust, and deterioration of image quality due to a change in dot size was not observed at all even when the ambient temperature varied during the plate-making procedure and the number of printing plates prepared with the apparatus was increased. In other words, satisfactory plate-making was accomplished.

The image formed on the printing plate precursor was hardened by heating with a xenon flash fixing device (made by USHIO INC.) under a luminous intensity of 200 J/pulse, thereby preparing a printing plate. Then, the ink jet recording device was moved away together with the subsidiary scanner from the position close to the plate cylinder and kept apart at a distance of 50 mm from the plate cylinder for the purpose of protecting the ejection head. Thereafter, printing was effected on printing coated paper using an ordinary lithographic printing method. In some detail, a printing ink and a dampening water were given to the printing plate to form a printing image thereon. The printing ink image thus formed was then transferred to the blanket cylinder rotating together with the plate cylinder. Subsequently, the printing ink image on the blanket cylinder was transferred to a printing coated paper passing through the gap between the blanket cylinder and the impression cylinder.

The print after printing 10,000 sheets had a very clear image without the occurrence of fading or sharpening of the printed image.

After the completion of plate-making, the ejection head was cleaned by supplying Isopar G to the head and dripping the Isopar G from the opening of the head for 10 minutes. Then, the head was stored in a cover filled with vapor of Isopar G. By this treatment, prints of good quality were provided for 6 months without any other work for maintenance.

Example 2

The same on-press recording type lithographic printing apparatus as used in Example 1 was used except that as a stirrer there was used a circulating pump and a 600 dpi full-line ink jet head as shown in FIG. 5 was installed. The pump was used in the present example. One ink reservoir was arranged between the pump and the ink flow-in course of the ejection head, and another ink reservoir was arranged between the ink recovery course of the ejection head and the ink tank. The ink was circulated by the difference in hydrostatic pressure between those reservoirs in addition to the action of the circulatory pump. Also, a combination of the circulatory pump with a heater was used for controlling the ink temperature, and the ink temperature was set at 35° C. and controlled with a thermostat. The circulatory pump was further used as stirrer for preventing precipitation and aggregation. The ink flow course was provided with a conductance measuring device, and according to output signals from the device, concentration control of the ink was carried out by diluting the ink or feeding concentrated ink. The same aluminum plate as described above was used as a printing plate precursor, and fixed to the plate cylinder of the lithographic printing apparatus in the same manner as described above. Dust on the surface of the printing plate precursor was removed with a rotating brush made of nylon. Then, the image data to be printed was transmitted to an arithmetic and control unit. Image forming was carried out by ejecting the oil-based ink from the full-line head onto the aluminum printing plate precursor while rotating the plate cylinder, thereby forming an image thereon. During this procedure, dust on the printing plate was optically sensed to produce an output signal by which dust was removed from the surface of the printing plate with a rotating brush made of nylon. An abnormal current flowing through the head was sensed to monitor the attachment of foreign matters to the head. The relative vibration of the head and the plate cylinder was sensed by an accelerometer mounted thereon, whereby the supply of recording signal into the head was suspended whenever any abnormality occurred. The image thus formed on the printing plate precursor had no defects due to dust, and deterioration of image quality due to a change in dot size was not observed at all even when the ambient temperature varied during the plate-making procedure and the number of printing plates prepared with the apparatus was increased. In other words, satisfactory plate-making was accomplished. On the other hand, vibration was forced onto the apparatus. As a result, the application of voltage to the head was temporarily suspended to stop image recording. When vibration ended, image recording was resumed. Thus, satisfactory plate-making was accomplished. Subsequently, the image was subjected to heat roll fixing (produced by Hitachi Metals, Ltd.; power consumption: 1.2 kW) to solidify, thereby making a printing plate.

Using the printing plate thus made, printing was then conducted. As a result, the print obtained had a very clear image without the occurrence of fading or sharpening of image even after printing 10,000 sheets. After the completion of plate-making, the ejection head was cleaned by circulating Isopar G therethrough and then bringing non-woven fabric impregnated with Isopar G into contact with the tip of the head. By this treatment, prints of good quality were provided for 6 months without any other work for maintenance.

The same procedure as mentioned above was followed except that a 600 dpi full-line ink jet head of the type shown in FIGS. 7 and 9 was used instead of an ink jet head of the type shown in FIG. 5. Good results were obtained similarly to the foregoing case.

Example 3

A full-line head as shown in FIG. 7 was mounted as an ejection head on the ink jet recording device of an on-press recording type four-color lithographic printing apparatus (see FIG. 10). Using a contact roller made of Teflon, the gap was adjusted to 0.8 mm. 5,000 sheets of printing plates were then prepared in the same manner as in Example 1 except that the ink tank was replenished with a concentrated ink according to the number of sheets having image recorded thereon to control the ink concentration. A device for optically sensing dust in the apparatus was mounted. The output from the sensing device was used to make suction on the surface of the printing plate material by an air pump. The image thus formed on the printing plate precursor showed no defects due to dust and was not affected by the change of the ambient temperature. As the number of sheets of printing plates made increased, the diameter of dots printed showed some but an acceptable change. The printing plates thus made were also subjected to flash fixing as mentioned above and fixing by irradiation with light from a halogen lamp (Type QIR, produced by USHIO INC.), or fixing with spray of ethyl acetate. For the fixing by irradiation with a halogen lamp, heating was effected so that the temperature of the surface of the printing plate reached 95° C. for 20 seconds. For the fixing with spray of ethyl acetate, the amount of ethyl acetate sprayed was adjusted to about 1 g/m$^2$. As a result, the print after printing 10,000 sheets had a very clear full-color image without the occurrence of fading or sharpening of the printed image. In particular, the fixing time in heat roll fixing or fixing by irradiation with light from a halogen lamp was drastically reduced by wrapping a heat insulating material (PET film) around the plate cylinder. In this case, the aluminum substrate was grounded through an electrically-conductive brush (Thunderlon, produced by Tuchiya K.K.; resistance: about $10^{-1}$ Ω-cm) which comes in contact therewith.

Example 4

The procedure of Example 1 was followed except that the aluminum printing plate precursor was replaced by a paper printing plate precursor comprising a hydrophilic image-receiving layer provided on the surface thereof.

High-quality paper having a basis weight of 100 g/m$^2$ was used as a substrate and, on both sides of the substrate, a water-resistant layer comprising as main ingredients kaolin and resin components, including polyvinyl alcohol, SBR latex and melamine resin, was provided to form a paper support. A dispersion A prepared from the following composition in the following manner was applied to the paper support in a dry coating amount of 6 g/m$^2$ to form an image-receiving layer, thereby preparing a paper printing plate precursor.

Dispersion A

| Dispersion A | |
|---|---|
| Gelatin (1st grade, produced by Wako Pure Chemical Industries, Ltd.) | 3 g |
| Colloidal silica (Snowtex C; produced by Nissan Chemical Industries, Ltd.; 20% aqueous solution) | 20 g |
| Silica gel (Silysya #310, produced by Fuji Silysya Chemical Co., Ltd.) | 7 g |
| Hardener (paraformaldehyde) | 0.4 g |
| Distilled water | 100 g |

The foregoing ingredients were subjected to dispersion together with glass beads in a paint shaker for 10 minutes.

The print after printing 10,000 sheets had a very clear image without the occurrence of fading or sharpening of the printed image.

On the other hand, printing plates were prepared in the same manner as in Example 1 except that as the printing paper there was used high-quality paper. During the printing of 3,000th sheet, the image was made solid on some area due to paper dust. Then, a device for optically sensing dust in the apparatus was mounted. The output from the sensing device was used to allow an air suction pump installed in the vicinity of the paper supplier to operate as a paper dust generation inhibiting device. Then, printing was resumed. As a result, no defectives in printing occurred. The print after printing 5,000 sheets had a very clear image without the occurrence of fading or sharpening of the printed image. However, the print after printing 5,000 sheets showed a longitudinal elongation of 0.1 mm on A3 size image.

Example 5

The same procedure as in Example 1 was performed, except that the printing plate precursor was replaced with a printing plate precursor provided with an image-receiving layer capable of being rendered hydrophilic upon an oil-desensitizing treatment described below, the non-image area of the printing plate prepared was rendered hydrophilic using a plate surface oil-desensitizing device, the conductive layer of the printing plate precursor was grounded by contact with a conductive leaf spring (made of phosphor bronze) during the recording operation, and fixing was carried out by exposing the printing plate precursor to hot air.

High-quality paper having a basis weight of 100 g/m$^2$ was used as a substrate and, on both sides of the substrate, a polyethylene film was laminated in a thickness of 20 $\mu$m to form a water-resistant paper support. On one side of the thus-prepared paper support, a coating for conductive layer having the following composition was coated in a dry coating amount of 10 g/m$^2$ to form a conductive layer and further thereon Dispersion B prepared in the manner indicated below was coated in a dry coating amount of 15 g/m$^2$ to form an image-receiving layer, thereby preparing a printing plate precursor.

Coating for Conductive Layer

A coating was prepared by mixing 5.4 parts of carbon black (30% aqueous dispersion), 54.6 parts of clay (50% aqueous dispersion), 36 parts of SBR latex (solid content: 50%, Tg: 25° C.) and 4 parts of melamine resin (solid content: 80%, Sumirez Resin SR-13), and then adding water thereto so as to have the total solid content of 25%.

Dispersion B

A mixture of 100 g of dry-type zinc oxide, 3 g of Binder Resin (B-1) having the structure shown below, 17 g of Binder Resin (B-2) having the structure shown below, 0.15 g of benzoic acid and 155 g of toluene was dispersed using a wet-type dispersing machine (Homogenizer made by Nippon Seiki Co., Ltd.) at 6,000 r.p.m. for 8 minutes.

[ka-3]

Binder Resin (B-1)

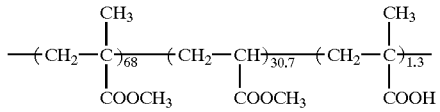

Mw: 9 × 10$^3$

Binder Resin (B-2)

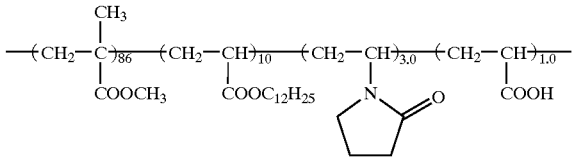

Mw: 4 × 10$^4$ (composition ratio: by weight)

The print after printing 5,000 sheets had a very clear image without the occurrence of fading or sharpening of the printed image.

According to the present invention, a large number of prints having clear images can be provided. Further, a printing plate of high image quality is directly formed on the press corresponding to digital image data in a stable manner, making it possible to conduct lithographic printing at a low cost and a high speed.

Example 6

An oil-based ink was prepared in the same manner as in Example 1.

An ink tank of an ink jet recording device of an on-press recording type lithographic printing apparatus (see FIGS. 1 and 2; free of cleaning device 60 but comprising a head protective device 20) was filled with 2 liters of Oil-Based Ink (IK-1) thus prepared. A 900 dpi 64-channel multiple channel head as shown in FIG. 4 was used as an ejection head. The head was housed in a cover with a shutter shown in FIG. 13. The head was moved forward to the image recording position with the shutter open only during image recording. A dust sensing device was installed to prevent damage on the head during the occurrence of abnormality. A drop-in type heater and stirring blades were installed for controlling the ink temperature in the ink tank. The ink temperature was set at 30° C., and temperature control was carried out with a thermostat while rotating the stirring blades at 30 r.p.m. Rotation of the stirring blades was also utilized for preventing precipitation and aggregation. Further, a portion of the ink flow course was made transparent, which portion was arranged between a light emission diode (LED) and a light detector. The concentration control of the ink was carried out by feeding diluent for the ink (Isoper G) or concentrated ink (the solid concentration of which was adjusted to twice that of Oil-Based Ink (IK-1)) according to the output of the light detector.

An aluminum plate having a thickness of 0.12 mm which had been subjected to graining and anodizing treatment was used as a printing plate precursor. The printing plate precursor was mounted on the plate cylinder with the head and end thereof being gripped by a mechanical device provided on the plate cylinder. With the dampening water supplier, the printing ink supplier and the blanket cylinder being separated from the printing plate precursor, dust on the printing plate precursor surface was removed by air-pump suction. Then, the ejection head was moved close to the printing plate precursor until it reached the recording position. Image data to be printed was transmitted to an arithmetic and control unit. While the 64-channel ejection head was being carried by the rotation of the plate cylinder, the oil-based ink was ejected onto the aluminum printing plate to form an image. During ejection, the ejection electrode of the ejection head had a tip width of 10 $\mu$m, and the distance between the head and the printing plate precursor was kept at 1 mm by utilizing output from an optically gap-detecting device. During ejection, a voltage of 2.5 kV was always applied as a bias voltage, and a pulse voltage of 500 V was further superimposed for each ejection of ink. The duration of pulse voltage was changed stepwise from 0.2 millisecond to 0.05 millisecond in 256 steps, thereby changing the dot area for recording. The image thus formed on the printing plate precursor had no defects due to dust, and deterioration of image quality due to a change in dot size was not observed at all even when the ambient temperature varied during the plate-making procedure and the number of printing plates prepared with the apparatus was increased. In other words, satisfactory plate-making was accomplished. No damage on the head was observed.

The image formed on the printing plate precursor was hardened by heating with a xenon flash fixing device (made by USHIO INC.) under a luminous intensity of 200 J/pulse, thereby preparing a printing plate. Then, the ink jet recording device was moved away together with the subsidiary scanner from the position close to the plate cylinder and kept apart at a distance of 50 mm from the plate cylinder for the purpose of protecting the ejection head. Thereafter, printing was effected on printing paper using an ordinary lithographic printing method. In some detail, a printing ink and a dampening water were given to the printing plate to form a printing image thereon. The printing ink image thus formed was then transferred to the blanket cylinder rotating together with the plate cylinder. Subsequently, the printing ink image on the blanket cylinder was transferred to a printing coated paper passing through the gap between the blanket cylinder and the impression cylinder.

The print after printing 10,000 sheets had a very clear image without the occurrence of fading or sharpening of the printed image. After the completion of plate-making, the ejection head was cleaned by supplying Isopar G to the head and dripping the Isopar G from the opening of the head for 10 minutes. Then, the head was stored in a cover filled with vapor of Isopar G. By this treatment, prints of good quality were provided for 3 months without any other work for maintenance.

Example 7

The same on-press recording type lithographic printing apparatus as used in Example 6 was used except that as a stirrer there was used a circulating pump and a 600 dpi full-line ink jet head as shown in FIGS. 5, 7 and 9 was installed. The head was housed in a cover with a shutter as in Example 6. In order to prevent the damage on the head during the occurrence of abnormality, an abnormal current sensing device was installed. The pump was used in the present example. One ink reservoir was arranged between the pump and the ink flow-in course of the ejection head, and another ink reservoir was arranged between the ink recovery course of the ejection head and the ink tank. The ink was circulated by the difference in hydrostatic pressure between those reservoirs in addition to the action of the circulatory pump. Also, a combination of the circulatory pump with a heater was used for controlling the ink temperature, and the ink temperature was set at 35° C. and controlled with a thermostat. The circulatory pump was further used as stirrer for preventing precipitation and aggregation. The ink flow course was provided with a conductance measuring device, and according to output signals from the device, concentration control of the ink was carried out by diluting the ink or feeding concentrated ink. The same aluminum plate as described above was used as a printing plate precursor, and fixed to the plate cylinder of the lithographic printing apparatus in the same manner as described above. Dust on the surface of the printing plate precursor was removed with a rotating brush made of nylon. Then, the image data to be printed was transmitted to an arithmetic and control unit. Image forming was carried out by ejecting the oil-based ink from the full-line head onto the aluminum printing plate precursor while rotating the plate cylinder, thereby forming an image thereon. The image thus formed on the printing plate precursor had no defects due to dust, and deterioration of image quality due to a change in dot size was not observed at all even when the ambient temperature varied during the plate-making procedure and the number of printing plates prepared with the apparatus was increased. In other words, satisfactory plate-making was accomplished. No damage on the head was observed.

Using the printing plate thus made, printing was then conducted. As a result, the print obtained had a very clear image without the occurrence of fading or sharpening of image even after printing 10,000 sheets. After the completion of plate-making, the ejection head was cleaned by circulating Isopar G therethrough and then bringing non-woven fabric impregnated with Isopar G into contact with the tip of the head. By this treatment, prints of good quality were provided for 3 months without any other work for maintenance.

Example 8

A full-line head as shown in FIG. 6 was mounted as an ejection head on the ink jet recording device of an on-press recording type four-color lithographic printing apparatus (see FIG. 10). using a contact roller made of Teflon, the gap was adjusted to 0.8 mm. 5,000 sheets of printing plates were then prepared in the same manner as in Example 6 except that the ink tank was replenished with a concentrated ink according to the number of sheets having image recorded thereon to control the ink concentration. As a result, the image thus formed on the printing plate precursor was not affected by the change of the ambient temperature. No damage on the head was observed. As the number of sheets of printing plates made increased, the diameter of dots printed showed some but an acceptable change. The printing plates thus made were also subjected to flash fixing as mentioned above, heat roll fixing (produced by Hitachi Metals, Ltd.; power consumption: 1.2 kW), fixing by irradiation with light from a halogen lamp (Type QIR, produced by USHIO INC. ), or fixing with spray of ethyl acetate.

For the heat roll fixing or fixing by irradiation with a halogen lamp, heating was effected so that the temperature of the surface of the printing plate reached 95° C. for 20 seconds. For the fixing with spray of ethyl acetate, the amount of ethyl acetate sprayed was adjusted to about 1 g/m$^2$. As a result, the print after printing 10,000 sheets had a very clear full-color image without the occurrence of fading or sharpening of the printed image. In particular, the fixing time in heat roll fixing or fixing by irradiation with light from a halogen lamp was drastically reduced by wrapping a heat insulating material (PET film) around the plate cylinder. In this case, the aluminum substrate was grounded through an electrically-conductive brush (Thunderlon, produced by Tuchiya K.K.; resistance: about $10^{-1}$ Ω-cm) which comes in contact therewith.

Example 9

The procedure of Example 6 was followed except that the aluminum printing plate precursor was replaced by a paper printing plate precursor comprising a hydrophilic image-receiving layer provided on the surface thereof.

High-quality paper having a basis weight of 100 g/m$^2$ was used as a substrate and, on both sides of the substrate, a water-resistant layer comprising as main ingredients kaolin and resin components, including polyvinyl alcohol, SBR latex and melamine resin, was provided to form a paper support. The dispersion A prepared in the same manner as in Example 4 was applied to the paper support in a dry coating amount of 6 g/m$^2$ to form an image-receiving layer, thereby preparing a paper printing plate precursor.

Printing plates were prepared in the same manner as in Example 6 except that as the printing paper there was used high-quality paper. During the printing of 3,000th sheet, the image was made solid on some area due to paper dust. Then, an air suction pump was installed as a paper dust generation inhibiting device in the vicinity of the paper supplier. Then, printing was resumed. As a result, no defectives in printing occurred. The print after printing 5,000 sheets had a very clear image without the occurrence of fading or sharpening of the printed image. However, the print after printing 5,000 sheets showed a longitudinal elongation of 0.1 mm on A3 size image.

Example 10

The same procedure as in Example 6 was performed, except that the printing plate precursor was replaced with a printing plate precursor provided with an image-receiving layer capable of being rendered hydrophilic upon an oil-desensitizing treatment described below, the non-image area of the printing plate prepared was rendered hydrophilic using a plate surface oil-desensitizing device, the conductive layer of the printing plate precursor was grounded by contact with a conductive leaf spring (made of phosphor bronze) during the recording operation, and fixing was carried out by exposing the printing plate precursor to hot air.

High-quality paper having a basis weight of 100 g/m$^2$ was used as a substrate and, on both sides of the substrate, a polyethylene film was laminated in a thickness of 20 μm to form a water-resistant paper support. On one side of the thus-prepared paper support, a coating for conductive layer prepared in the same manner as in Example 5 was coated in a dry coating amount of 10 g/m$^2$ to form a conductive layer and further thereon Dispersion B prepared in the manner indicated below was coated in a dry coating amount of 15 g/m$^2$ to form an image-receiving layer, thereby preparing a printing plate precursor.

The print after printing 5,000 sheets had a very clear image without the occurrence of fading or sharpening of the printed image.

According to the present invention, a large number of prints having clear images can be provided. Further, a printing plate of high image quality is directly formed on the press corresponding to digital image data in a stable manner, making it possible to conduct lithographic printing at a low cost and a high speed.

Example 11

An oil-based ink was prepared in the same manner as in Example 1.

An ink tank of an ink jet recording device of an on-press recording type lithographic printing apparatus (see FIGS. 1 and 2; comprising a cleaning device 60 but free of head protective device 20) was filled with 2 liters of Oil-Based Ink (IK-1) thus prepared. A 900 dpi 64-channel multiple channel head as shown in FIG. 3 was used as an ejection head. A drop-in type heater and stirring blades were installed for controlling the ink temperature in the ink tank. The ink temperature was set at 30° C., and temperature control was carried out with a thermostat while rotating the stirring blades at 30 r.p.m. Rotation of the stirring blades was also utilized for preventing precipitation and aggregation. Further, a portion of the ink flow course was made transparent, which portion was arranged between a light emission diode (LED) and a light detector. The concentration control of the ink was carried out by feeding diluent for the ink (Isoper G) or concentrated ink (the solid concentration of which was adjusted to twice that of Oil-Based Ink (IK-1)) according to the output of the light detector. An aluminum plate having a thickness of 0.12 mm which had been subjected to graining and anodizing treatment was used as a printing plate precursor. The printing plate precursor was mounted on the plate cylinder with the head and end thereof being gripped by a mechanical device provided on the plate cylinder. With the dampening water supplier, the printing ink supplier and the blanket cylinder being separated from the printing plate precursor, dust on the printing plate precursor surface was removed by air-pump suction. Then, the ejection head was moved close to the printing plate precursor until it reached the recording position. Image data to be printed was transmitted to an arithmetic and control unit. While the 64-channel ejection head was being carried by the rotation of the plate cylinder, the oil-based ink was ejected onto the aluminum printing plate to form an image. During ejection, the ejection electrode of the ejection head had a tip width of 10 μm, and the distance between the head and the printing plate precursor was kept at 1 mm by utilizing output from an optically gap-detecting device. During ejection, a voltage of 2.5 kV was always applied as a bias voltage, and a pulse voltage of 500 V was further superimposed for each ejection of ink. The duration of pulse voltage was changed stepwise from 0.2 millisecond to 0.05 millisecond in 256 steps, thereby changing the dot area for recording. The image thus formed on the printing plate precursor had no defects due to dust, and deterioration of image quality due to a change in dot size was not observed at all even when the ambient temperature varied during the plate-making procedure and the number of printing plates prepared with the apparatus was increased. In other words, satisfactory plate-making was accomplished.

The image formed on the printing plate precursor was hardened by heating with a xenon flash fixing device (made by USHIO INC.) under a luminous intensity of 200 J/pulse, thereby preparing a printing plate. Then, the ink jet recording device was moved away together with the subsidiary scanner from the position close to the plate cylinder and kept apart at a distance of 50 mm from the plate cylinder for the purpose of protecting the ejection head. Thereafter, printing was effected on printing coated paper using an ordinary lithographic printing method. In some detail, a printing ink and a dampening water were given to the printing plate to form a printing image thereon. The printing ink image thus formed was then transferred to the blanket cylinder rotating together with the plate cylinder. Subsequently, the printing ink image on the blanket cylinder was transferred to a printing coated paper passing through the gap between the blanket cylinder and the impression cylinder.

The print after printing 10,000 sheets had a very clear image without the occurrence of fading or sharpening of the printed image.

After the completion of plate-making, the tip of the ejection head was dipped in Isopar G under the application of a 1 kV positive dc voltage for 30 seconds. By this treatment, prints of good quality were provided for 6 months without any other work for maintenance.

Example 12

The same on-press recording type lithographic printing apparatus as used in Example 11 was used except that as a stirrer there was used a circulating pump and a 600 dpi full-line ink jet head as shown in FIG. 5 was installed. The pump was used in the present example. One ink reservoir was arranged between the pump and the ink flow-in course of the ejection head, and another ink reservoir was arranged between the ink recovery course of the ejection head and the ink tank. The ink was circulated by the difference in hydrostatic pressure between those reservoirs in addition to the action of the circulatory pump. Also, a combination of the circulatory pump with a heater was used for controlling the ink temperature, and the ink temperature was set at 35° C. and controlled with a thermostat. The circulatory pump was further used as stirrer for preventing precipitation and aggregation. The ink flow course was provided with a conductance measuring device, and according to output signals from the device, concentration control of the ink was carried out by diluting the ink or feeding concentrated ink. The same aluminum plate as described above was used as a printing plate precursor, and fixed to the plate cylinder of the lithographic printing apparatus in the same manner as described above. Dust on the surface of the printing plate precursor was removed with a rotating brush made of nylon. Then, the image data to be printed was transmitted to an arithmetic and control unit. Image forming was carried out by ejecting the oil-based ink from the full-line head onto the aluminum printing plate precursor while rotating the plate cylinder, thereby forming an image thereon. The image thus formed on the printing plate precursor had no defects due to dust, and deterioration of image quality due to a change in dot size was not observed at all even when the ambient temperature varied during the plate-making procedure and the number of printing plates prepared with the apparatus was increased. In other words, satisfactory plate-making was accomplished. Subsequently, the image was subjected to heat roll fixing (produced by Hitachi Metals, Ltd.; power consumption: 1.2 kW) to solidify, thereby making a printing plate.

Using the printing plate thus made, printing was then conducted. As a result, the print obtained had a very clear image without the occurrence of fading or sharpening of image even after printing 10,000 sheets. After the completion of plate-making, the tip of the ejection head was dipped in Isopar G under the application of a 1 kv positive dc voltage for 30 seconds. By this treatment, prints of good quality were provided for 6 months without any other work for maintenance.

The same procedure as mentioned above was followed except that a 600 dpi full-line ink jet head of the type shown in FIGS. 7 and 9 was used instead of an ink jet head of the type shown in FIG. 5. Good results were obtained similarly to the foregoing case.

Example 13

A full-line head as shown in FIG. 7 was mounted as an ejection head on the ink jet recording device of an on-press recording type four-color lithographic printing apparatus. Using a contact roller made of Teflon, the gap was adjusted to 0.8 mm. 5,000 sheets of printing plates were then prepared in the same manner as in Example 11 except that the ink tank was replenished with a concentrated ink according to the number of sheets having image recorded thereon to control the ink concentration. As a result, the image thus formed on the printing plate precursor showed no defects due to dust and was not affected by the change of the ambient temperature. As the number of sheets of printing plates made increased, the diameter of dots printed showed some but an acceptable change. The printing plates thus made were also subjected to flash fixing as mentioned above, fixing by irradiation with light from a halogen lamp (Type QIR, produced by USHIO INC.), or fixing with spray of ethyl acetate. For the fixing by irradiation with a halogen lamp, heating was effected so that the temperature of the surface of the printing plate reached 95° C. for 20 seconds. For the fixing with spray of ethyl acetate, the amount of ethyl acetate sprayed was adjusted to about 1 g/m$^2$. As a result, the print after printing 10,000 sheets had a very clear full-color image without the occurrence of fading or sharpening of the printed image. In particular, the fixing time in heat roll fixing or fixing by irradiation with light from a halogen lamp was drastically reduced by wrapping a heat insulating material (PET film) around the plate cylinder. In this case, the aluminum substrate was grounded through an electrically-conductive brush (Thunderlon, produced by Tuchiya K.K.; resistance: about $10^{-1}$ Ω-cm) which comes in contact therewith. After the completion of plate-making, the tip of the ejection head was cleaned by dipping in Isopar G under the application of a 0.8 kv positive dc voltage having a 0.3 kv 50 Hz ac voltage imposed thereon for 10 seconds. By this treatment, prints of good quality were provided for 6 months without any other work for maintenance.

Example 14

The procedure of Example 1 was followed except that the aluminum printing plate precursor of Example 11 was replaced by a paper printing plate precursor comprising a hydrophilic image-receiving layer provided on the surface thereof.

High-quality paper having a basis weight of 100 g/m$^2$ was used as a substrate and, on both sides of the substrate, a water-resistant layer comprising as main ingredients kaolin and resin components, including polyvinyl alcohol, SBR latex and melamine resin, was provided to form a paper support. A dispersion A prepared in the same manner as in Example 4 was applied to the paper support in a dry coating amount of 6 g/m$^2$ to form an image-receiving layer, thereby preparing a paper printing plate precursor.

The print after printing 10,000 sheets had a very clear image without the occurrence of fading or sharpening of the printed image.

On the other hand, printing plates were prepared in the same manner as in Example 1 except that as the printing paper there was used high-quality paper. During the printing of 3,000th sheet, the image was made solid on some area due to paper dust. Then, an air suction pump was installed as a paper dust generation inhibiting device in the vicinity of the paper supplier. Then, printing was resumed. As a result, no defectives in printing occurred. The print after printing 5,000 sheets had a very clear image without the occurrence of fading or sharpening of the printed image. However, the print after printing 5,000 sheets showed a longitudinal elongation of 0.1 mm on A3size image. After the completion of plate-making, the tip of the ejection head was dried by a dryer. As a result, the ink was solidified to cause image defects during the subsequent plate-making. Then, the tip of the ejection head was dipped in Isoper C under the application of a 1 kV positive dc voltage having a 0.6 kV 60 Hz ac voltage imposed thereon for 1 minute. As a result, image defects were eliminated. By this treatment, prints of good quality were provided for 6 months without any other work for maintenance.

Example 15

The same procedure as in Example 11 was performed, except that the printing plate precursor was replaced with a printing plate precursor provided with an image-receiving layer capable of being rendered hydrophilic upon an oil-desensitizing treatment described below, the non-image area of the printing plate prepared was rendered hydrophilic using a plate surface oil-desensitizing device, the conductive layer of the printing plate precursor was grounded by contact with a conductive leaf spring (made of phosphor bronze) during the recording operation, and fixing was carried out by exposing the printing plate precursor to hot air.

High-quality paper having a basis weight of 100 g/m$^2$ was used as a substrate and, on both sides of the substrate, a polyethylene film was laminated in a thickness of 20 $\mu$m to form a water-resistant paper support. On one side of the thus-prepared paper support, a coating for conductive layer prepared in the same manner as in Example 10 was coated in a dry coating amount of 10 g/m$^2$ to form a conductive layer and further thereon Dispersion B prepared in the manner indicated below was coated in a dry coating amount of 15 g/m$^2$ to form an image-receiving layer, thereby preparing a printing plate precursor.

The print after printing 5,000 sheets had a very clear image without the occurrence of fading or sharpening of the printed image. After the completion of plate-making, the tip of the recording head was cleaned by dipping in isopropanol under the application of a 0.5 kV ac voltage for 20 seconds. By this treatment, prints of good quality were provided for 6 months without any other work for maintenance.

According to the present invention, a large number of prints having clear images can be provided. Further, a printing plate of high image quality is directly formed on the press corresponding to digital image data in a stable manner, making it possible to conduct lithographic printing at a low cost and a high speed.

What is claimed is:

1. An on-press recording type lithographic printing method involving an ink jet process which comprises:

ejecting an oil-based ink from an ejection head onto a printing plate material mounted on a plate cylinder of a press utilizing an electrostatic field which corresponds to signals of image data, whereby an image is directly formed on the surface of a printing plate precursor, thereby preparing a printing plate which is then used to effect lithographic printing, providing a flow of current through the ejection head;

detecting the flow of current through the ejection head using a detecting circuit to determine if foreign matter is present; and comparing the flow of current to a stored reference signal to determine if the flow of current is abnormal, wherein when any abnormality occurs, the formation of the image is suspended and/or the cause of abnormality is removed.

2. An on-press recording type lithographic printing apparatus comprising:

an ink jet recording device provided with a recording head which ejects an oil-based ink and utilizes an electrostatic field for directly forming an image on a printing plate material according to signals of image data, a lithographic printing means for effecting lithographic printing using a printing plate formed by said ink jet recording device, and at least one of an abnormality sensing means and a means of removing a cause of an abnormality, said abnormality sensing means being operative to perform at least one of suspending the forming of the image and controlling at least temporarily, the means of removing the cause, and said means of removing the cause operative to remove a cause of the abnormality, said abnormality sensing means having a recording head foreign matter attachment sensing device for sensing the attachment of foreign matters to said ink jet recording device, which is operative to sense a flow of current through the recording head.

3. The on-press recording type lithographic printing apparatus according to claim 2, wherein the recording head foreign matter attachment sensing device uses a current detecting circuit to detect the flow of current through the recording head, wherein the flow of current is compared to a stored reference signal to determine if the flow of current is abnormal.

4. An on-press recording type lithographic printing apparatus comprising:

an ink jet recording device provided with a recording head which ejects an ink and utilizes an electrostatic field for directly forming an image on a printing plate material according to signals of image data, a lithographic printer which prints using a printing plate formed by said ink jet recording device, and a recording head foreign matter attachment sensing device for sensing the attachment of foreign matters to said ink jet recording device, wherein said recording head foreign matter attachment sensing device is operative to sense a flow of current through the recording head using a current detecting circuit, wherein the flow of current is compared to a stored reference signal to determine if the flow of current is abnormal.

* * * * *